US005738452A

United States Patent [19]

Uchida

[11] Patent Number: 5,738,452

[45] Date of Patent: Apr. 14, 1998

[54] SHEET SEPARATION DEVICE IN A SUPPLYING APPARATUS

[75] Inventor: Haruo Uchida, Yokohama, Japan

[73] Assignee: Canon Kabushiki Kaisha, Tokyo, Japan

[21] Appl. No.: 364,725

[22] Filed: Dec. 27, 1994

[30] Foreign Application Priority Data

Dec. 29, 1993 [JP] Japan ..... 5-352984
Aug. 1, 1994 [JP] Japan ..... 6-199066

[51] Int. Cl.[6] ..... B41J 11/58

[52] U.S. Cl. ..... 400/624; 271/121; 271/21

[58] Field of Search ..... 400/624, 629; 271/21, 22, 109, 114, 118, 119, 121, 122, 125, 126

[56] References Cited

U.S. PATENT DOCUMENTS 4,318,287 3/1982 Okayama ..... 274/121
4,858,907 8/1989 Eisner et al. ..... 400/624

FOREIGN PATENT DOCUMENTS 60-048842 3/1985 Japan .
60-128146 7/1985 Japan .
62-105834 5/1987 Japan .
63-037042 2/1988 Japan ..... 271/121
01-022743 1/1989 Japan ..... 271/121
01-214541 8/1989 Japan ..... 271/121
64-054248 11/1989 Japan .
02-265834 10/1990 Japan ..... 271/121
04-075928 3/1992 Japan ..... 271/121
2 257 425 1/1993 United Kingdom ..... 271/121

*Primary Examiner*—David A. Wiecking
*Attorney, Agent, or Firm*—Fitzpatrick, Cella, Harper & Scinto

[57] ABSTRACT

A sheet supplying apparatus includes a sheet supply roller provided at its periphery with a cylindrical portion for supplying a sheet and a cut-out portion having a radial distance smaller than a radius of the cylindrical portion, a friction separator moving toward and away from the sheet supply roller to separate sheets one by one when it is contacted by the cylindrical portion of the sheet supply roller, and a biasing mechanism for biasing the friction separator toward the sheet supply roller. In addition, a rotation controller stops the sheet supply roller so that the cut-out portion is opposed to the friction separator when the feeding of the sheet effected by the sheet supply roller is finished, and a guide is arranged for pinching the sheet, which is fed out by a force smaller than a pinching force for pinching the sheet between the cylindrical portion and the friction separator, between the friction separator and the guide when the sheet supply roller is stopped by the rotation controller.

17 Claims, 23 Drawing Sheets

SHEET SEPARATION DEVICE IN A SUPPLYING APPARATUS

BACKGROUND OF THE INVENTION

1. Field of the Invention

The present invention relates to a sheet supplying apparatus for separating and supplying a recording material, a copying material or an original one by one to a recording station, a copying station or a reading station in a recording apparatus, an image forming apparatus or an image reading apparatus such as a printer, a copying machine, a printing apparatus, a scanner and the like.

2. Related Background Art

For example, in conventional sheet supplying apparatuses for ink jet recording apparatuses, as disclosed in the Japanese Patent Publication No. 1-54248, Japanese Patent Appln. Laid-Open Nos. 60-48842, 60-128146 and 62-105834, in order to separate sheets (recording materials), there has been used a separating mechanism of the type wherein a separation roller is urged against and driven by a sheet supply roller so that a single recording material is separated from the other recording materials by applying to the separation roller a braking torque greater than a friction force between the recording materials and smaller than a friction force between the separation roller and the recording material.

That is to say, as shown in FIG. 18, the sheet supplying apparatus includes a sheet supply roller 21 against which a separation roller 29 is urged. The sheet supply roller 21 is rotated in an anti-clockwise direction shown by the arrow (sheet supplying direction). The separation roller 29 is driven by rotation of the sheet supply roller 21. A braking torque greater than a friction force between recording materials 10 and smaller than a friction force between the separation roller 29 and the recording material 10 is applied to the separation roller 29.

With this arrangement, even if two or more recording materials $\mathbf{10}_1$, $\mathbf{10}_2$, . . . are introduced into a nip between the sheet supply roller 21 and the separation roller 29, only an uppermost recording material $\mathbf{10}_1$ directly contacted with the sheet supply roller 21 passes through the nip between the sheet supply roller 21 and the separation roller 29 toward the sheet supplying direction A by the rotation of the sheet supply roller 21 and the other recording materials $\mathbf{10}_2$, $\mathbf{10}_3$, . . . are prevented from passing through the nip between the sheet supply roller 21 and the separation roller 29 by a returning action due to the braking torque of the separation roller 29. After all, only the uppermost recording material $\mathbf{10}_1$ which directly receives a conveying force from the sheet supply roller 21 is conveyed without double-feed of the recording materials.

The recording material $\mathbf{10}_1$ separated and conveyed by the sheet supply roller 21 and the separation roller 29 is guided by sheet guides 18, 22 to be entered into a nip between a pair of convey rollers 4, 5, thereby further conveying the recording material, as shown in FIG. 19. After a tip end of the recording material $\mathbf{10}_1$ was pinched by the nip between the pair of convey rollers 4, 5, the sheet supply roller 21 is stopped (completion of the sheet supplying operation effected by the sheet supply roller 21).

However, in the above-mentioned conventional sheet supplying apparatus, as shown in FIG. 19, after the sheet supplying operation effected by the sheet supply roller 21 is completed, in a condition that the recording material $\mathbf{10}_1$ is being conveyed by the pair of convey rollers 4, 5, since sliding resistence from the stopped sheet supply roller 21 and the braking torque from the driven separation roller 29 are applied to the recording material $\mathbf{10}_1$, back tension on the recording material $\mathbf{10}_1$ is increased, with the result that the recording material is slipped in the nip between the pair of convey rollers 4, 5, thereby causing the poor supply of the recording material or decreasing a sheet feeding amount to a recording station (not shown) below a predetermined amount to cause the poor image such as black stripe in the image. Further, although it is considered that pressure between the convey rollers 4, 5 can be increased to eliminate the slipping of the recording material in the nip between the pair of convey rollers 4, 5, to do so results in the pressurizing mechanism becoming bulky and the driving torque for driving the convey rollers 4, 5 being increased, thereby requiring a greater drive motor and making the apparatus more expensive.

To eliminate the above drawbacks, it is considered that the sheet supply roller 21 is driven in synchronous with the pair of convey rollers 4, 5 to convey the recording material $\mathbf{10}_1$ even after the sheet supplying operation effected by the sheet supply roller 21 is completed. However, in order to rotate the sheet supply roller 21 in synchronous with the pair of convey rollers 4, 5, the accuracy of the driving system and the manufacturing accuracy of the rollers must be enhanced, thereby making the entire apparatus expensive. Further, it is also considered that a one-way clutch is provided in association with the sheet supply roller 21 so that the sheet supply roller 21 is driven by the conveying movement of the recording material $\mathbf{10}_1$ after the sheet supplying operation effected by the sheet supply roller 21 is completed. However, also in this case, since the idle rotation torque of the one-way clutch and the braking torque of the separation roller 29 are applied to the recording material $\mathbf{10}_1$, the back tension on the recording material $\mathbf{10}_1$ is increased, thereby arising the above-mentioned problems.

SUMMARY OF THE INVENTION

Accordingly, an object of the present invention is to provide a sheet supplying apparatus in which a friction separation means is urged against a sheet supply roller to separate sheets one by one and which can eliminate the above mentioned problems regarding the back tension by reducing the back tension acting on the sheet conveyed by a pair of convey rollers after a sheet supplying operation is finished.

To achieve the above objects, according to one aspect of the present invention, there is provided a sheet supplying apparatus comprising a sheet supply roller provided at its periphery with a cylindrical portion for supplying a sheet and a cut-out portion having a radial distance (from a center of the sheet supply roller) smaller than a radius of the cylindrical portion, friction separation means capable of being moved toward and away from the sheet supply roller and adapted to separate sheets one by one when it is contacted with the cylindrical portion of the sheet supply roller, and biasing means for biaing the friction separation means toward the sheet supply roller. Rotation control means stops the sheet supply roller so that the cut-out portion is opposed to the friction separation means when the feeding of the sheet effected by the sheet supply roller is finished, and guide means is arranged to pinch the sheet which is fed out by a force smaller than a pinching force for pinching the sheet between the cylindrical portion and the friction separation means, between the friction separation means and the guide means when the sheet supply roller is stopped by the rotation control means.

According to another aspect of the present invention, there is provided a sheet supplying apparatus comprising a sheet supply roller provided at its periphery with a cylindrical portion for supplying a sheet and a cut-out portion having a radial distance (from a center of the sheet supply roller) smaller than radius of the cylindrical portion, a friction separation means capable of being moved toward and away from the sheet supply roller and adapted to separate sheets one by one when it is contacted with the cylindrical portion of the sheet supply roller, and biasing means for biasing the friction separation means toward the sheet supply roller. In addition, rotation control means stops the sheet supply roller so that the cut-out portion is opposed to the friction separation means when the feeding of the sheet effected by the sheet supply roller is finished, guide means is arranged in coaxial with the sheet supply roller, and a guide supporting means supports the guide means so that the guide means can be shifted toward a direction extending from an axis of the sheet supply roller to the friction separation means, and wherein the sheet which is fed out by a force smaller than a pinching force for pinching the sheet between the cylindrical portion and the friction separation means is pinched between the guide means and the friction separation means when the sheet supply roller is stopped by the rotation control means.

According to a further aspect of the present invention, there is provided a sheet supplying apparatus comprising a sheet supply roller provided at its periphery with a cylindrical portion for supplying a sheet and a cut-out portion having a radial distance (from a center of the sheet supply roller) smaller than a radius of the cylindrical portion, friction separation means capable of being moved toward and away from the sheet supply roller and adapted to separate sheets one by one when it is contacted with the cylindrical portion of the sheet supply roller, and biasing means for biasing the friction separation means toward the sheet supply roller. In addition, rotation control means stops the sheet supply roller so that the cut-out portion is opposed to the friction separation means when the feeding of the sheet effected by the sheet supply roller is finished, stopper means stops the friction separation means at a predetermined position in opposition to a biasing force of the biasing means when the sheet supply roller is stopped by the rotation control means, and guide means is arranged to pinch the sheet which is fed out by a force smaller than a pinching force for pinching the sheet between the cylindrical portion and the friction separation means, between the guide means and the friction separation means stopped by the stopper means.

DETAILED DESCRIPTION OF THE PREFERRED EMBODIMENTS

<First Embodiment> (FIGS. 1 to 9)

Figure 1:
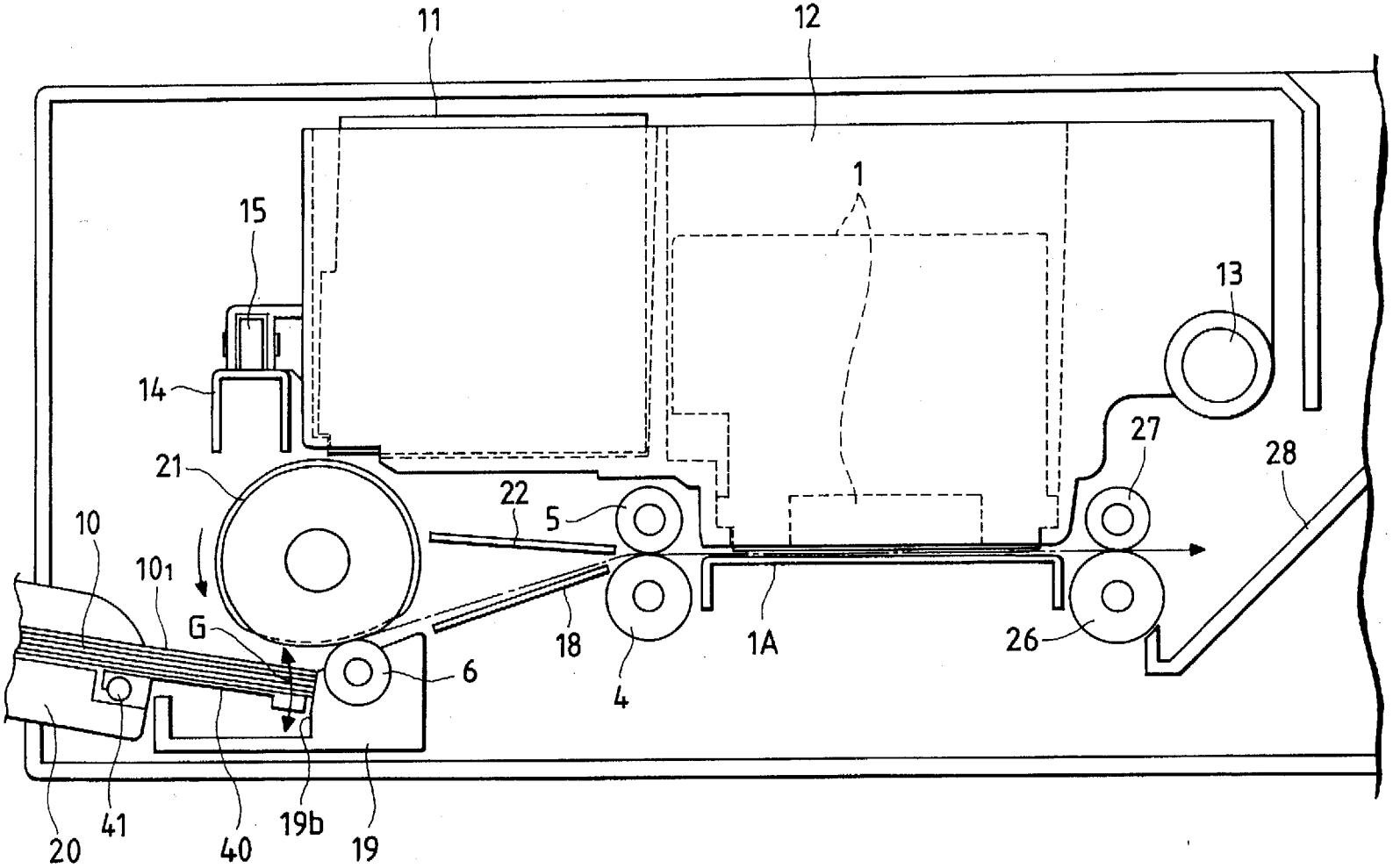
FIG. 1 is a schematic elevational sectional view of a recording apparatus incorporating a sheet supplying apparatus according to a first embodiment of the present invention.

(1) Recording Apparatus (FIG. 1)

FIG. 1 is a schematic constructural view of a recording apparatus having a sheet supplying apparatus according to a first embodiment of the present invention. The recording apparatus is embodied as an ink jet recording apparatus.

The recording apparatus comprises a recording head 1 for effecting the recording by selectively discharging ink from a plurality of nozzles, and an ink tank 11 for supplying the ink to the recording head. The recording head 1 and the ink tank 11 are mounted on a main scan carriage 12. The main scan carriage 12 is supported by a cylindrical guide rail 13, a guide rail 14 and rollers 15 and can be reciprocally shifted along the guide rails 13, 14 in a direction (main scan. direction) perpendicular to the plane of FIG. 1. The reciprocal shifting movement of the main scan carriage 12 in a recording area is controlled by transmitting a driving force from a drive source such as a reversible control motor via a timing belt (not shown). That is to say, the reciprocal shifting movement of the recording head 1 is controlled. Incidentally, the reference numeral 1A denotes a platen plate arranged in an opposed relation to a downwardly directed head surface of the recording head 1.

The sheet supplying apparatus comprises a sheet supply tray 20 forwardly and downwardly inclined with respect to one end of the recording apparatus, and a sheet supply intermediate plate 40 arranged in the promixity of a forward end of the sheet supply tray 20. The sheet supply intermediate plate 40 can be rocked around a rear support shaft 41 in directions shown by the arrow G so that the plate is lifted by a cam means (not shown) when a recording material is to be supplied and the plate is lowered when the recording material is not supplied. The recording materials 10 are stacked on the sheet supply tray 20 and the sheet supply intermediate plate 40 in such a manner that tip ends of the recording materials are abutted against a sheet end regulating surface **19*b* of a sheet supply base 19**.

A sheet supply roller 21 is arranged above the sheet supply base 19, and a separation roller 6 is mounted on the sheet supply base 19 and is urged against the sheet supply roller 21. The sheet supply roller 21 and the separation roller 6 will be fully described later.

When a sheet supply start signal is emitted, the sheet supply intermediate plate 40 is rocked upwardly around the support shaft 41, so that an upper surface of the sheet stack 10 near a tip end thereof is contacted with the sheet supply roller 21 in front of the 10 separation roller 6. When the sheet supply roller 21 is rotated in a sheet supplying direction shown by the arrow, the sheet supply roller 21 cooperates with the separation roller 6 so that only an uppermost recording material $\mathbf{10}_1$ is separated from the sheet stack 10 and conveyed through a nip between the sheet supply roller 21 and the separation roller 6 without double-feed of the recording materials. The separated recording material $\mathbf{10}_1$ is guided by sheet guides 18, 22 to reach a nip between a pair of convey rollers (regist rollers) 4, 5. Then, the recording material $\mathbf{10}_1$ is pinched between the pair of convey rollers 4, 5 to be conveyed to a recording station between the recording head 1 and the platen plate 1A.

By controlling the conveyance (sub-scan conveyance) of the recording material at the recording station, the reciprocal shifting movement of the recording head in the main scan direction and the ink discharge from the recording head, desired image information is successively recorded on the recording material. The recording material on which the image was recorded is discharged onto a discharge tray 28 by a pair of discharge rollers 26, 27.

(2) Sheet Supplying Mechanism

Figure 2:
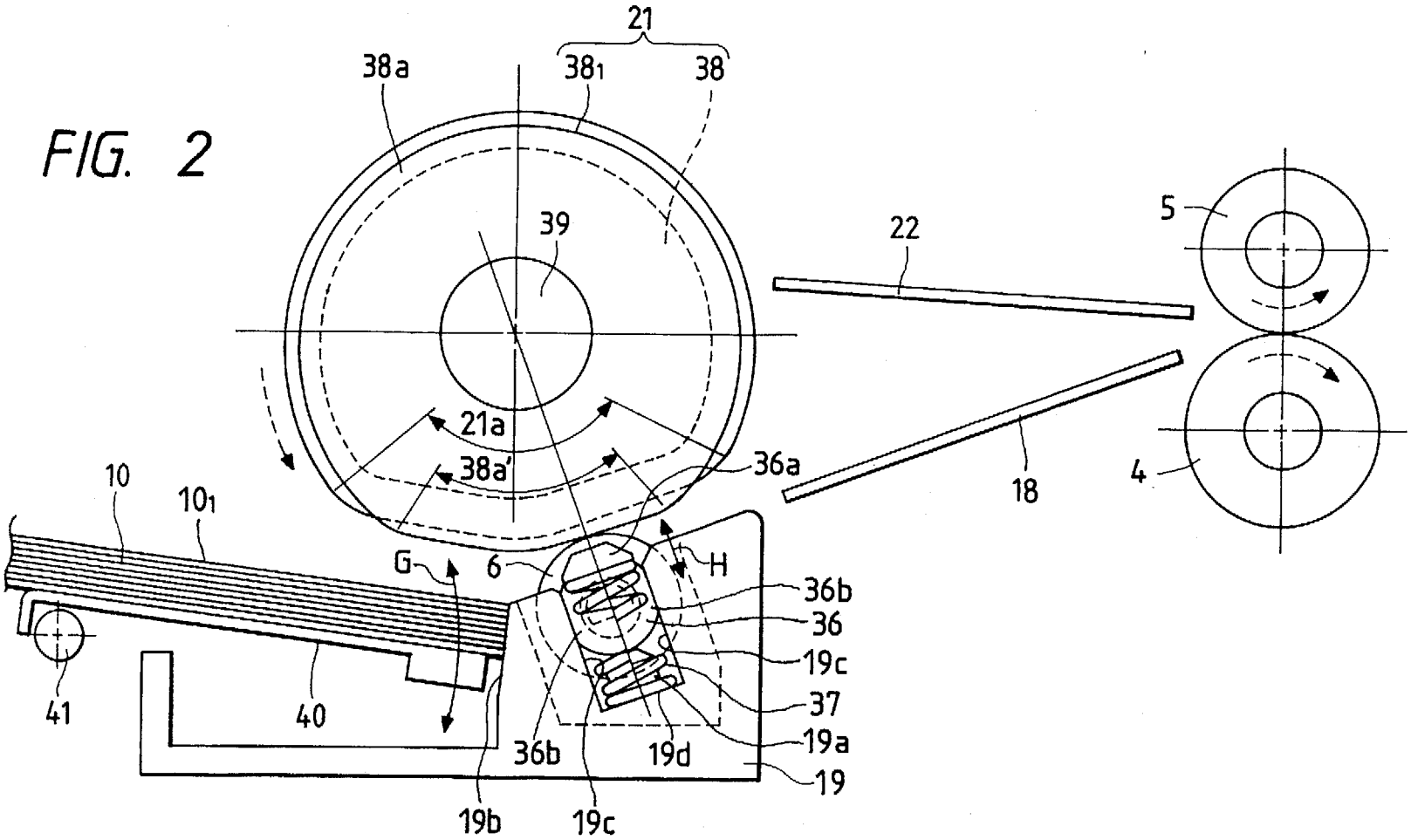
FIG. 2 is a side view of a sheet supplying mechanism showing a waiting condition.
Figure 3:
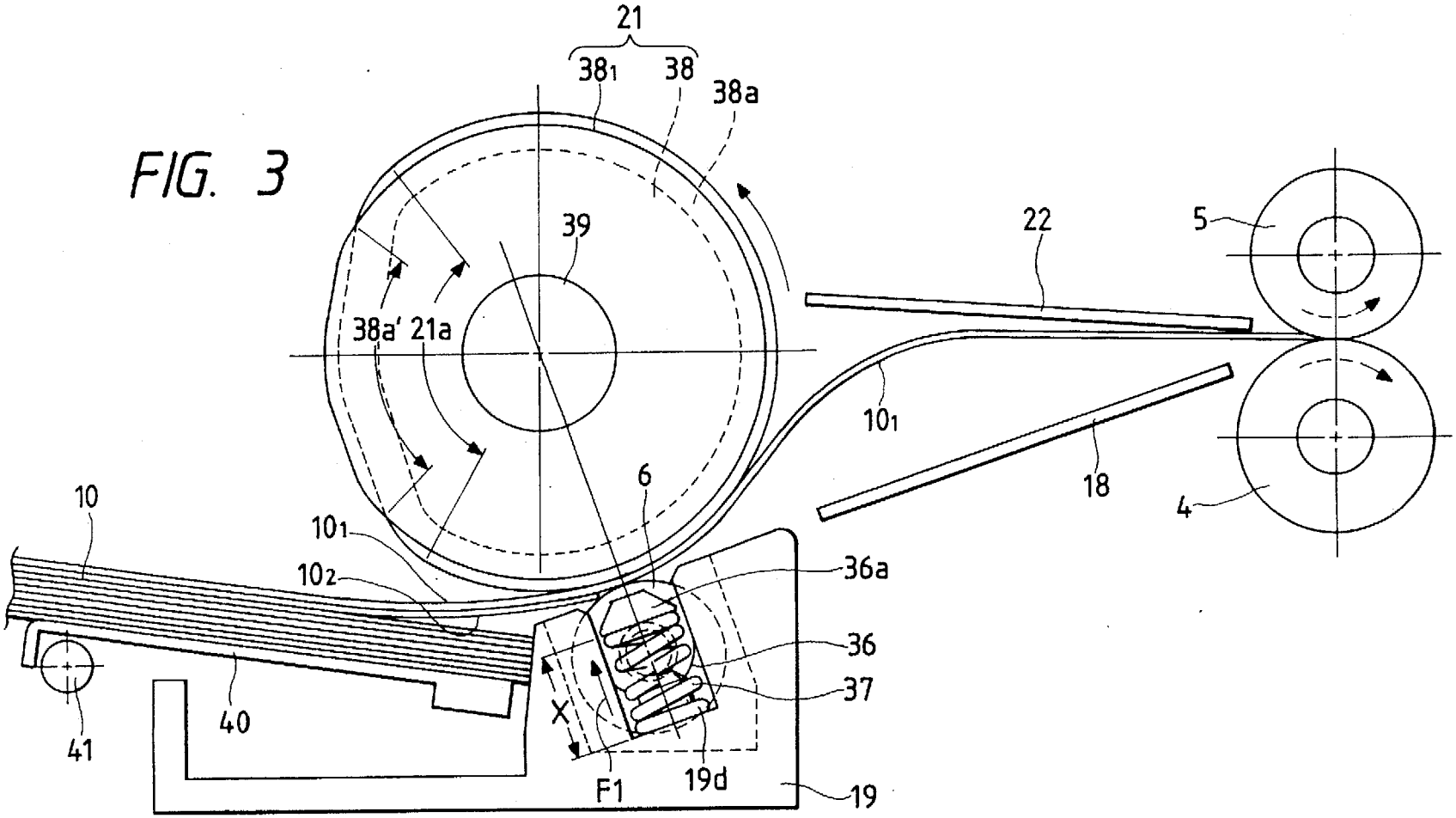
FIG. 3 is a side view of the sheet supplying mechanism showing a condition that a loop is formed in a recording material supplied from a sheet supply tray by a sheet supply roller and abutted against a nip between a pair of convey rollers.
Figure 4:
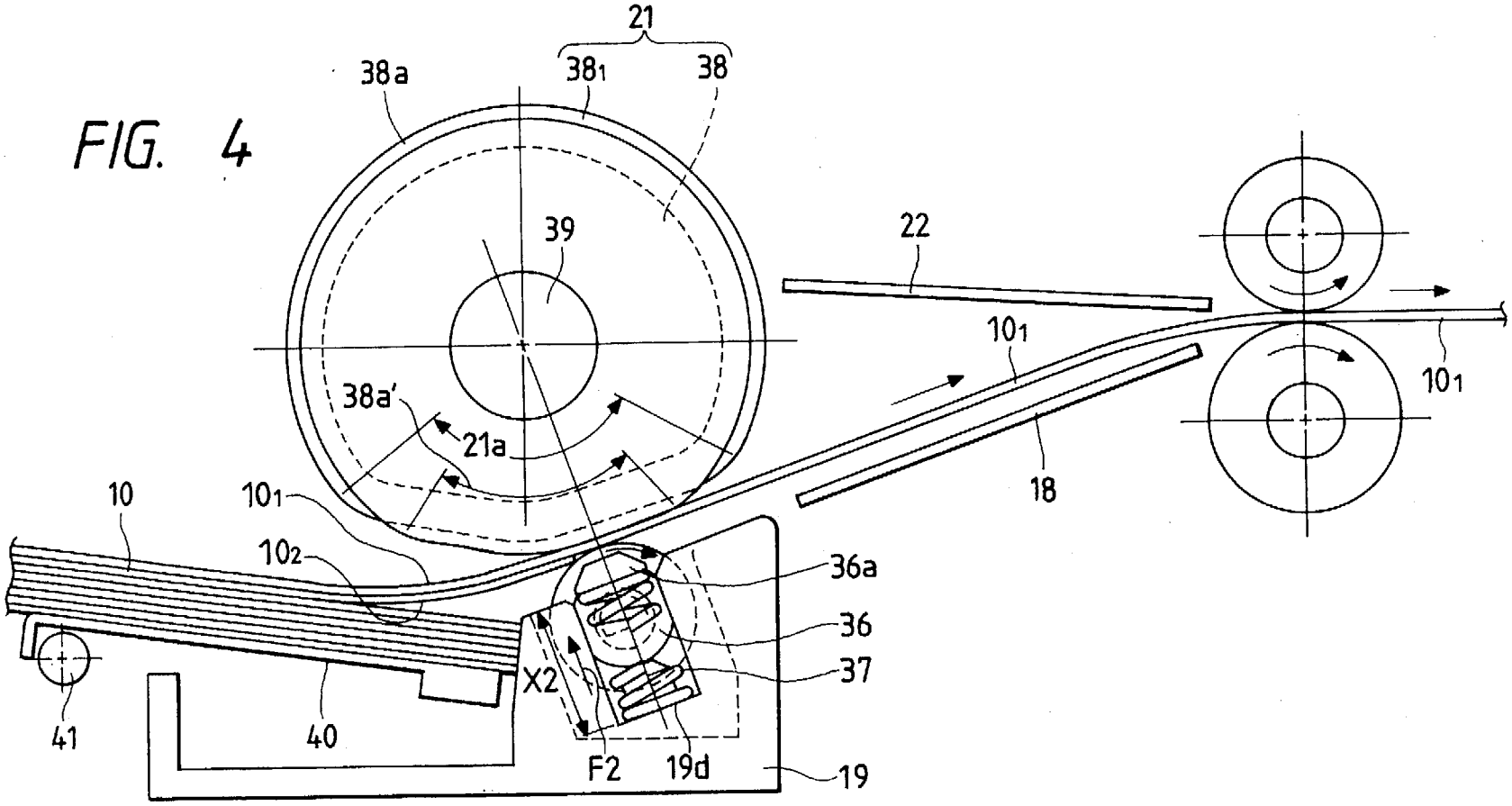
FIG. 4 is a side view of the sheet supplying mechanism showing a condition that the sheet supply roller is stopped and the recording material is being further conveyed by the pair of convey rollers.
Figure 5:
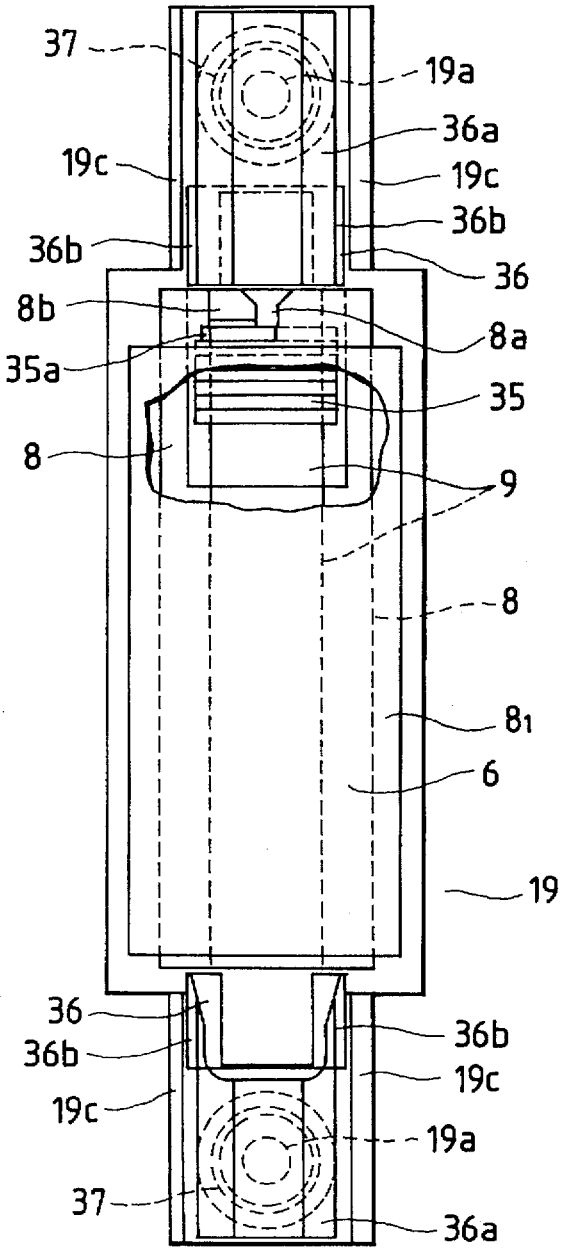
FIG. 5 is a plan view, in partial fragment, of a separation roller.
Figure 6:
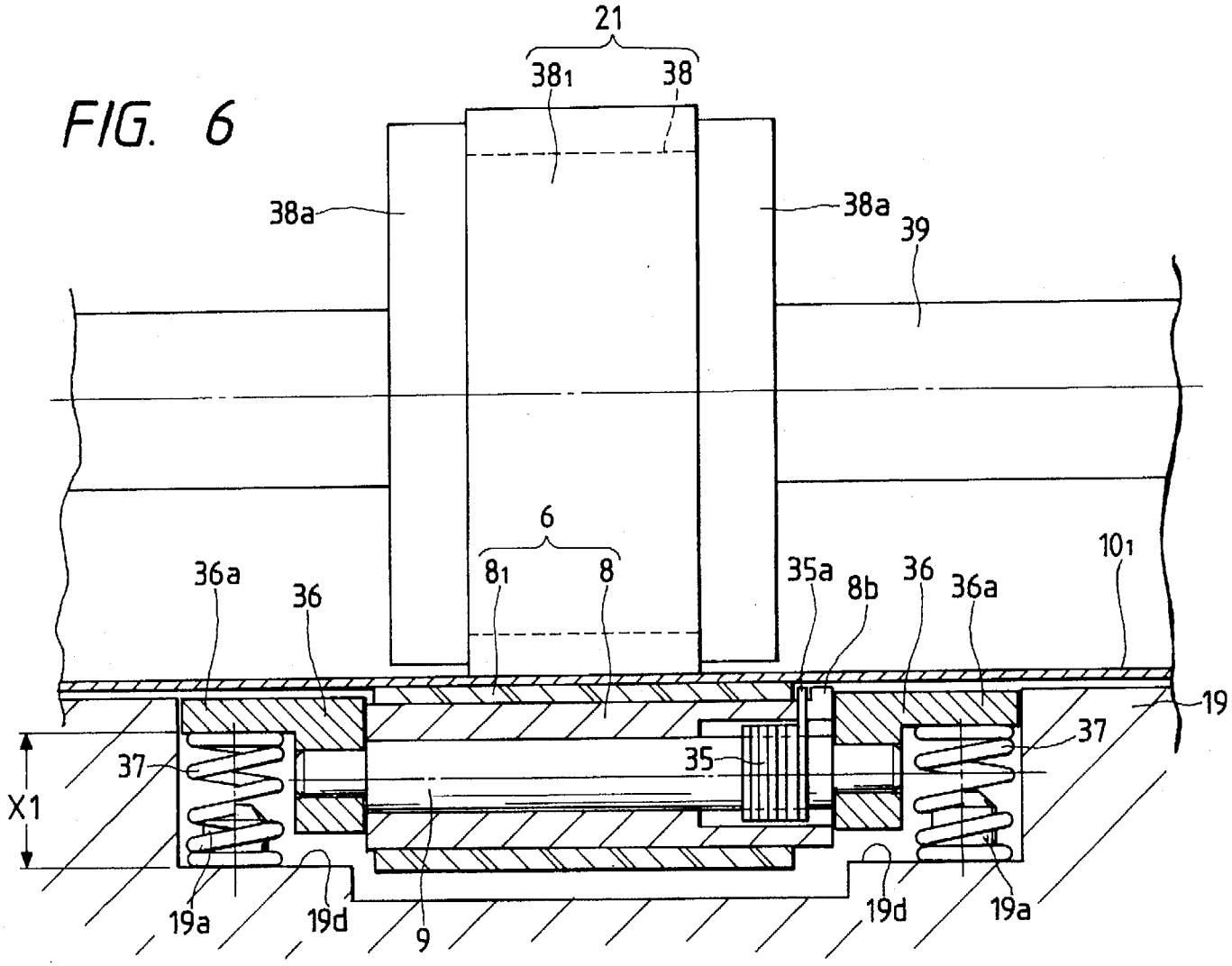
FIG. 6 is a front view of the sheet supply roller and the separation roller in the condition shown in FIG. 3 (the separation roller is shown as a sectional view)
Figure 7:
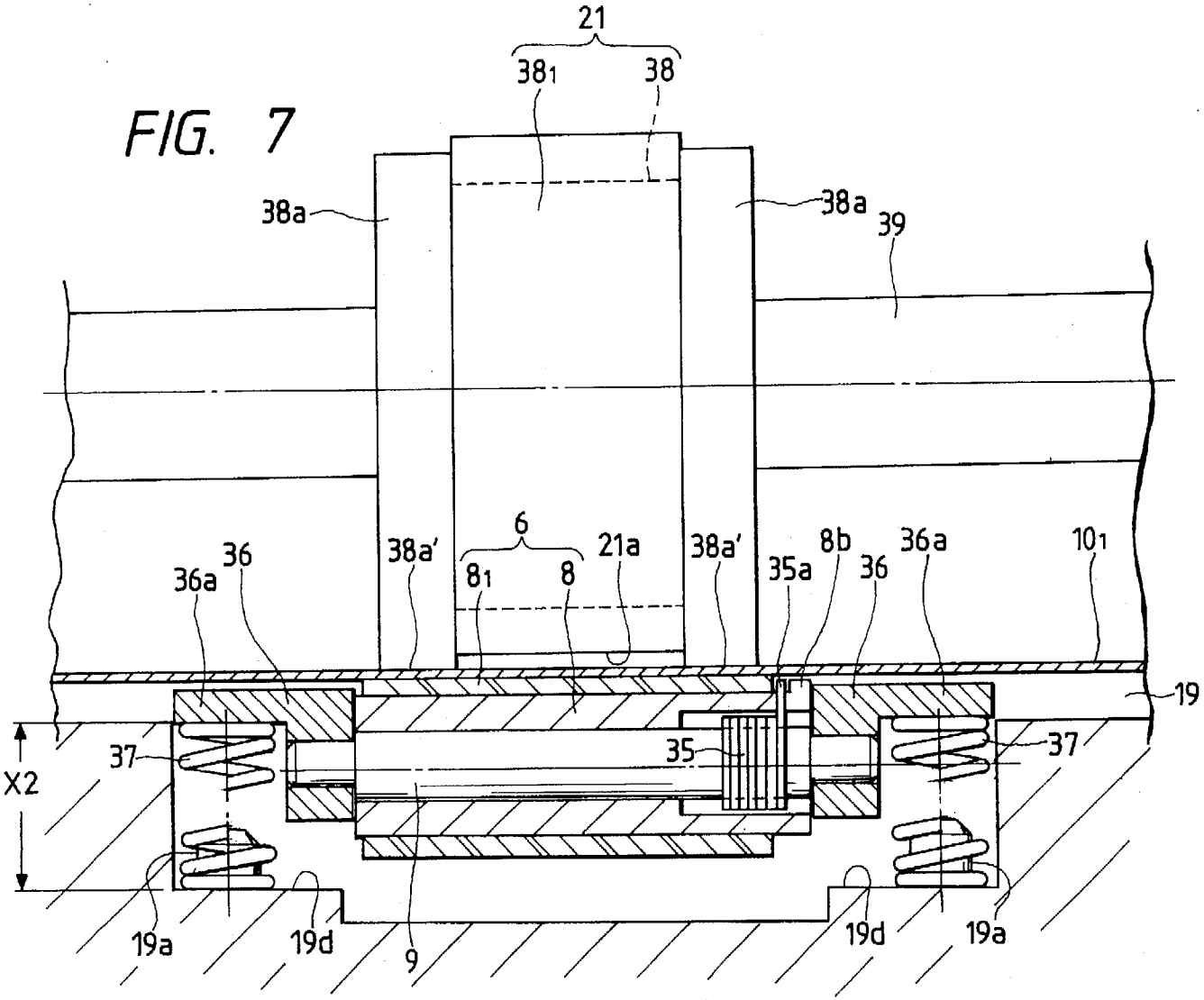
FIG. 7 is a front view of the sheet supply roller and the separation roller in the condition shown in FIG. 4 (the separation roller is shown as a sectional view)
Figure 8:
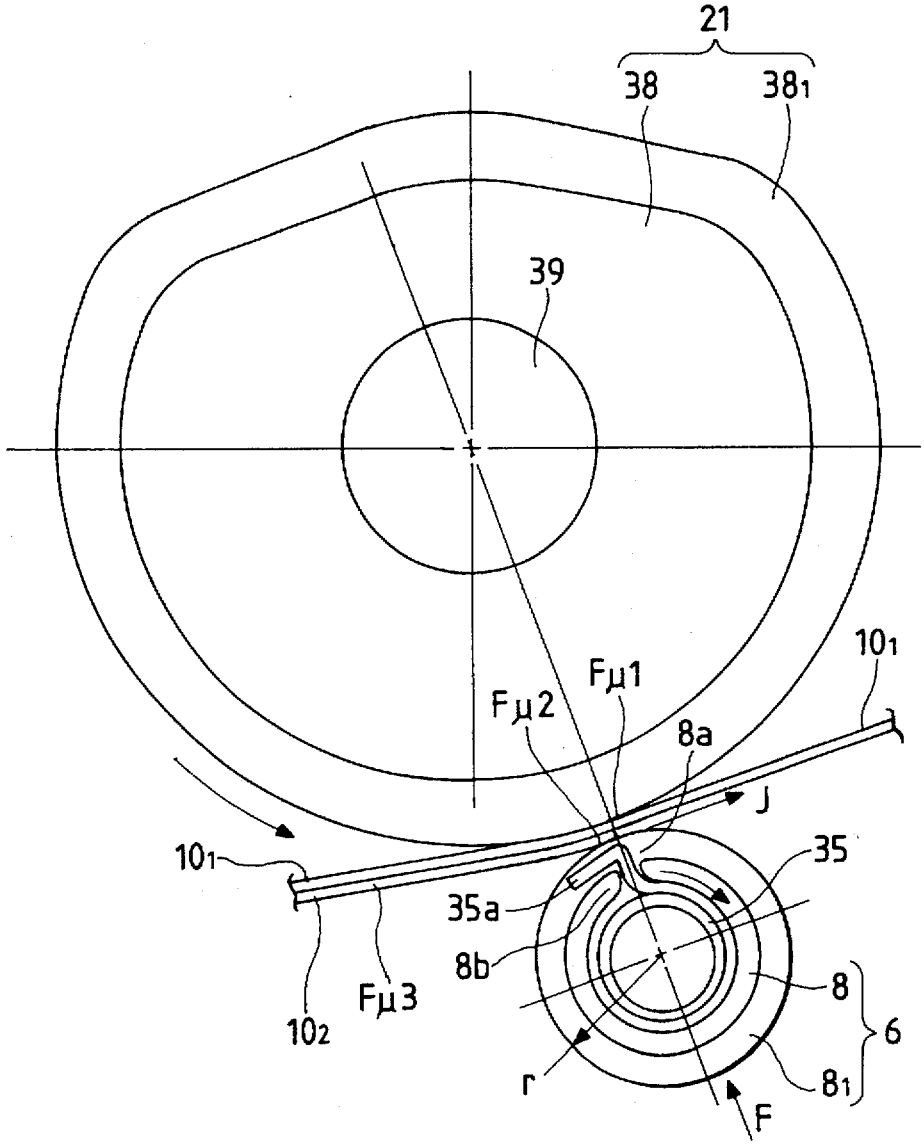
FIGS. 8 and 9 are views for explaining an operation for separating a single recording material.
Figure 9:
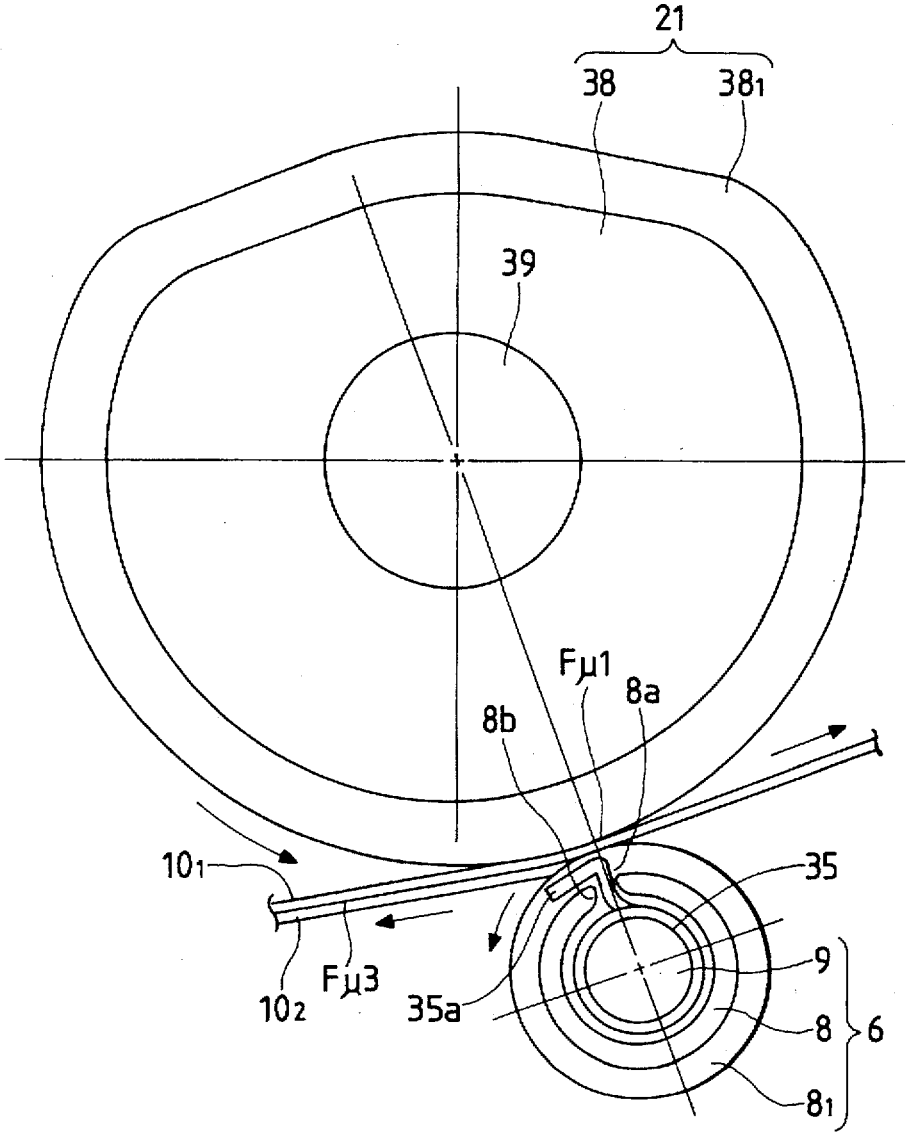

FIG. 2 is an enlarged view of a sheet supplying mechanism and is a side view showing a waiting condition. FIGS. 3 and 4 show conditions that the uppermost recording material on the sheet supply tray is being separated and conveyed from the waiting condition during one revolution of the sheet supply roller. FIG. 5 is a plan view, in partial fragment, of the separation roller. FIG. 6 is a front view of the sheet supply roller and the separation roller in the condition shown in FIG. 3 (the separation roller is shown as a sectional view). FIG. 7 is a front view of the sheet supply roller and the separation roller in the condition shown in FIG. 4 (the separation roller is shown as a sectional view), and FIGS. 8 and 9 are views for explaining an operation for separating a single recording material.

(a) Construction of Mechanism

Referring mainly to FIGS. 2, 5 and 6, the sheet supply roller 21 is made of elastic material having high coefficient of friction to convey the recording material 10, and more particularly, it is constituted by a metal core portion 38 and such elastic material layer $\mathbf{38}_1$ coated around the metal core. The sheet supply roller 21 is provided at its periphery with an area (cut-out portion) **21*a* having a radius smaller than that of the other portion of the roller. Guide portions 38*a* integrally formed with the metal core 38 are arranged on both sides of the sheet supply roller 21 (FIG. 6). The guide portions 38*a* are made of material (such as resin) having low coefficient of friction. At each guide portion 38*a*, a peripheral surface portion 38*a*' corresponding to the area (cut-out portion) 21*a* having the radius smaller than that of the other portion of the roller is designed to be greater than the radius of the sheet supply roller 21 and smaller than the radius of the guide portion 38*a***.

The sheet supply roller 21 and the integrated guide portions **38*a* are secured to and rotated together with a sheet supply roller shaft 39** which can be rotated by one revolution in the sheet supplying direction by a one-revolution clutch and a solenoid (not shown).

The separation roller 6 is mounted on the sheet supply base 19 below the sheet supply roller 21. The separation roller 6 is made of elastic material having high coefficient of friction to separate and convey the recording material 10, and more particularly, it is constituted by a metal core portion 8 (FIG. 6) and such elastic material layer $\mathbf{8}_1$ coated around the metal core. The metal core 8 of the separation roller 6 is rotatably mounted on a separation roller shaft 9, and separation roller bearings 36 are attached to both ends of the separation roller shaft 9. The separation roller shaft 9 is non-rotatably fitted in the separation roller bearings 38.

The separation roller 6 is supported for rocking movement substantially in a vertical direction shown by the arrow H in FIG. 2 so that positioning portions **36*b* of the separation roller bearings 36 are guided by guide portions 19*c* of the sheet supply base 19. Further, in order to bias the separation roller 6 toward the sheet supply roller 21, separation roller pressurizing springs 37 are disposed between spring seat portions 36*a* of the separation roller bearings 36 and spring positioning portions 19*d* of the sheet supply base 19. The separation roller pressurizing springs 37 are positioned by positioning pins 19*a* of the sheet supply base 19**.

A torsion coil clutch spring 35 is attached to the separation roller shaft 9 with predetermined interference. One end **35*a* of the clutch spring 35 is secured to a spring securing notched portion 8*a* formed in the metal core 8 of the separation roller 6**.

(b) Operation of Separation Roller 6 (FIGS. 8 and 9)

When a conveying force greater than a predetermined conveying force is applied to the peripheral surface of the separation roller 6 in the sheet supplying direction, as shown in FIG. 8, the metal core 8 is rotated in a direction shown by the arrow to abut an engagement portion 8*b* between the metal core 8 and the clutch spring 35 against the engagement portion (one end) 35*a* of the clutch spring 35, thereby rotating the clutch spring 35 together with the metal core 8 around the separation roller shaft 9 in a direction shown by the arrow. That is to say, the separation roller 6 is rotated when the conveying force exceeds the loosening torque (idle rotation torque).

It is assumed that an urging force of the separation roller 6 against the sheet supply roller 21 is F, a coefficient of friction between the sheet supply roller 21 and the recording material $\mathbf{10}_1$ is μ1, a coefficient of friction between the separation roller 6 and the recording material $\mathbf{10}_2$ is μ2, a coefficient of friction between the recording material $\mathbf{10}_1$ and the recording material $\mathbf{10}_2$ is μ3, a radius of the separation roller 6 is r, and a conveying force acting on the outer peripheral surface of the separation roller 6 and starting the slipping of the clutch spring 35 is J. In this case, the setting of the loosing torque (idle rotation torque) T (=Jr) will now be described.

In order to separate the recording materials 10, a friction force Fμ1 between the sheet supply roller 21 and the recording material $\mathbf{10}_1$, and a friction force Fμ2 between the separation roller 6 and the recording material $\mathbf{10}_2$ must be greater than a friction force Fμ3 between the recording material $\mathbf{10}_1$ and the recording material $\mathbf{10}_2$. That is to say, the following relation (1) must be satisfied:

$$F\mu 1,\ F\mu 2 > F\mu 3 \qquad (1)$$

Next, regarding the separation roller 6, if a single recording material 10 is conveyed, the separation roller 6 must be rotated together with the sheet supply roller 21 with the interposition of the recording material 10 without any slip, and, if two recording material $\mathbf{10}_1$, $\mathbf{10}_2$ are conveyed (FIG. 8), the separation roller must apply a returning force (FIG. 9) to the recording material $\mathbf{10}_2$ near the separation roller. Further, the conveying force J starting the slipping of the clutch spring 35 must be greater than the friction force Fμ3 between the recording material $\mathbf{10}_1$ and the recording material $\mathbf{10}_2$ and smaller than the friction force Fμ2 between the separation roller 6 and the recording material $\mathbf{10}_2$. That is to say, the following relation (2) must be satisfied:

$$F\mu 2 > J > F\mu 3 \qquad (2)$$

Thus, the loosing torque (idle rotation torque) T (=Jr) may be selected to satisfy this relation (2).

Next, the actual separating operation for separating the recording materials will be explained. If the single recording material $\mathbf{10}_1$ is conveyed between the separation roller 6 and the sheet supply roller 21, since the friction force Fμ2 between the separation roller 6 and the recording material $\mathbf{10}_2$ is greater than the conveying force J starting the slipping of the clutch spring 35, the separation roller 6 is rotated together with the sheet supply roller 21 with the interposition of the recording material $\mathbf{10}_1$.

In this condition, as shown in FIG. 8, if two recording materials $\mathbf{10}_1$, $\mathbf{10}_2$ are entered between the rollers 6, 21, the charged loosening torque (idle rotation torque) T acts on the recording material $\mathbf{10}_2$ near the separation roller 6, thereby quickly kicking back the recording material $\mathbf{10}_2$.

As shown in FIG. 9, the recording material $\mathbf{10}_2$ is returned rearwardly from the nip between the sheet supply roller 21 and the separation roller 6. This means that, since the friction force Fμ3 between the recording material $\mathbf{10}_1$ and the recording material $\mathbf{10}_2$ is smaller than the conveying force J starting the slipping of the clutch spring 35, the recording material $\mathbf{10}_2$ is returned together with the separation roller 6. Thus, by utilizing the above-mentioned separating mechanism, sheet supply without the double-feed of the recording materials can be achieved.

(c) Sheet Supplying Operation (i) In the waiting condition shown in FIG. 2, the sheet supply roller 21 and the guide portions 38*a* are stopped so that the cut-out portion 21*a* and the peripheral surface portions (small diameter portions) 38*a*' are directed downwardly. The separation roller 6 is abutted against the small diameter portions 38*a*'.

(ii) From the waiting condition shown in FIG. 2, when the sheet supply start signal is emitted, the solenoid of the one-revolution clutch is energized to turn the clutch ON, with the result that the driving force of the drive source (not shown) is transmitted to the sheet supply roller shaft 39, thereby rotating the sheet supply roller 21 and the guide portions 38*a* in the sheet supplying direction.

At the same time, the sheet supply intermediate plate 40 of the sheet supply tray 20 is rocked upwardly by the cam mechanism (not shown). As a result, the upper surface of the tip end portion of the sheet stack 10 is urged against the cylindrical portion of the sheet supply roller 21 other than the cut-out portion 21*a* with predetermined abutting pressure, thereby applying the conveying force to the uppermost recording material $\mathbf{10}_1$ to convey the uppermost recording materal $\mathbf{10}_1$ to the nip between the sheet supply roller 21 and the separation roller 6. When the sheet supply roller 21 is further rotated, the uppermost recording material $\mathbf{10}_1$ is conveyed by the sheet supply roller 21. In this case, by the separating operation (FIGS. 8 and 9) of the separation roller 6 as mentioned above, the recording materials are positively separated one by one at the nip without the double-feed. Further, after the tip end of the uppermost recording material $\mathbf{10}_1$ enters into the nip between the sheet supply roller 21 and the separation roller 6, the sheet supply intermediate plate 40 of the sheet supply tray 20 is lowered by the cam mechanism (not shown).

When the sheet supply roller 21 is further rotated in the sheet supplying direction, as shown in FIG. 3, the tip end of the separated recording material $\mathbf{10}_1$ reaches the nip between the pair of convey rollers (regist rollers) 4, 5 which are now stopped, and then, a loop is formed in the recording material $\mathbf{10}_1$ between the nip of the convey rollers 4, 5 and the nip of the rollers 21, 6, thereby correcting the skew-feed of the recording material $\mathbf{10}_1$.

During the rotation of the sheet supply roller 21, the separation roller 6 is being rotated together with the sheet supply roller 21 with the interposition of the recording material 10. In this case, the pressurizing force F1 of the separation roller 6 becomes greater, since the separation roller 6 is lowered to a lowermost position by the cylindrical portion (other than the cut-out portion) of the sheet supply roller 21 to shorten the separation roller pressurizing springs 37 (distance X1) as shown in FIGS. 3 and 6. After the tip end of the recording material $\mathbf{10}_1$ is abutted against the pair of regist rollers 4, 5 and the loop is formed in the recording material $\mathbf{10}_1$, the pair of regist rollers 4, 5 are rotated in synchronism with the sheet supply roller 21 at a predetermined point.

(iii) When the sheet supply roller 21 is rotated by one revolution, the one-revolution clutch is turned OFF, thereby stopping the sheet supply roller. At this point, the sheet supplying operation effected by the sheet supply roller 21 is finished.

The recording material $\mathbf{10}_1$ is conveyed by the pair of regist rollers 4, 5 which are still rotated after the sheet supply roller 21 is rotated by one revolution. FIG. 4 shows such a condition. The recording material $\mathbf{10}_1$ conveyed by the pair of regist rollers 4, 5 is conveyed to the recording station, where the image is recorded on the recording material. In this case, the sheet supply roller 21 is stopped, and the recording material $\mathbf{10}_1$ is conveyed by the pair of regist rollers 4, 5 in a condition that the recording material is pinched between the separation roller 6 and the guide portions 38*a*' integrally formed with the metal core 38 of the sheet supply roller 21. As shown in FIGS. 4 and 7, since the separation roller 6 is urged downwardly by the guide portions 38*a*' having the smaller radius than that of the sheet supply roller 21, the length (distance X2) of each separation roller pressurizing spring 37 becomes greater than the length (distance X1) during the sheet supplying operation, with the result that the urging force F2 of the separation roller 6 becomes smaller than the urging force F1 during the sheet supplying operation.

Further, since the guide portions 38*a*' made of material (such as resin) having low coefficient of friction are contacted with the recording material $\mathbf{10}_1$, the sliding resistance acting on the recording material $\mathbf{10}_1$ becomes small, thereby preventing the deterioration of the imaged surface of the recording material $\mathbf{10}_1$ due to the sliding movement. Further, since the sliding resistance is small, the back tension on the recording material generated by the conveying force of the pair of regist rollers 4, 5 can be decreased.

<Second Embodiment>(FIGS. 10 to 13)

In a sheet supplying apparatus according to a second embodiment, an urging force is applied from the separation roller during the sheet supplying operation, and an urging force is applied from the guide portions of the sheet supply roller when the sheet supplying operation is finished.

Figure 10:
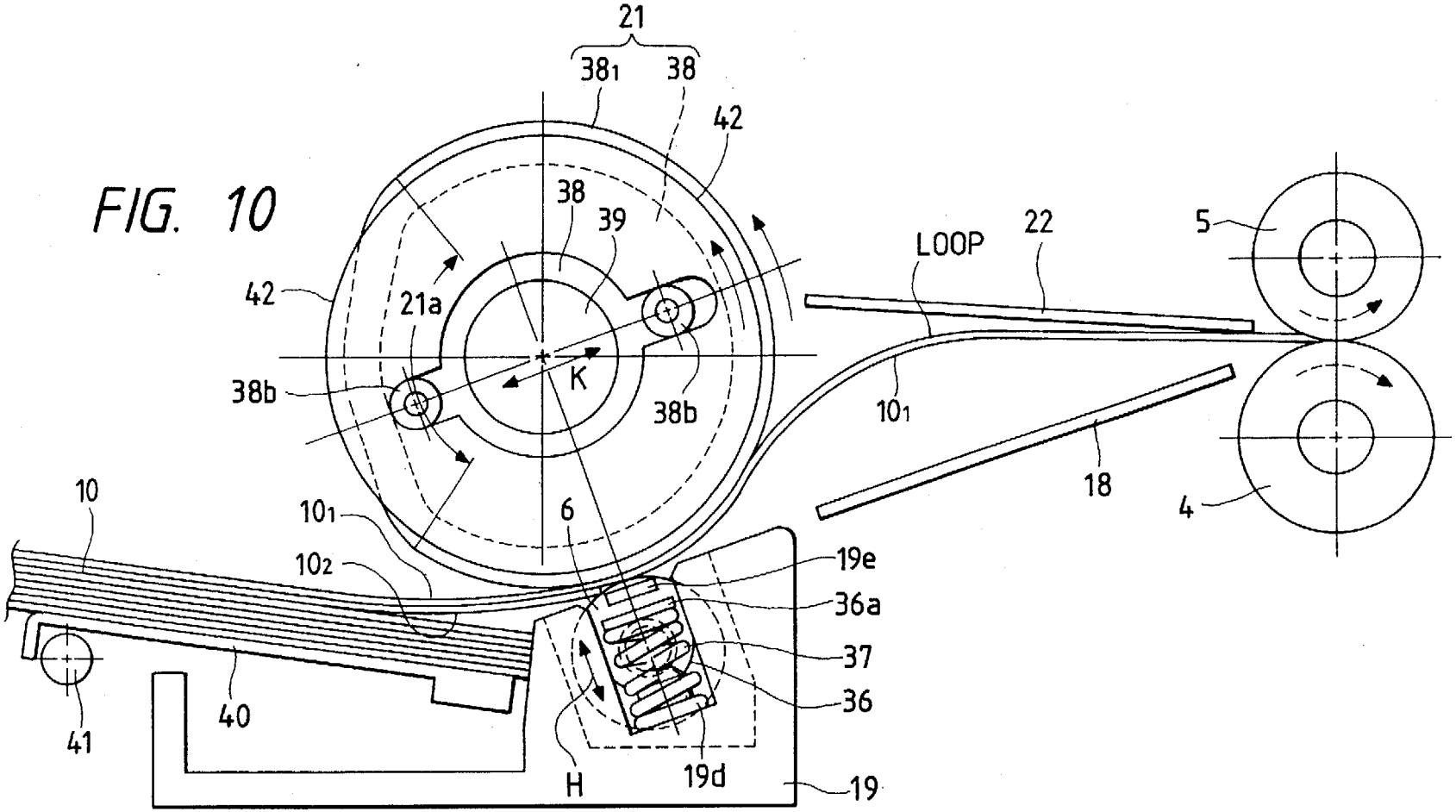
FIG. 10 is a side view of a sheet supplying mechanism of a sheet supplying apparatus according to a second embodiment of the present invention, showing a condition that a loop is formed in a recording material supplied by a sheet supply roller and abutted against a nip between a pair of convey rollers.
Figure 11:
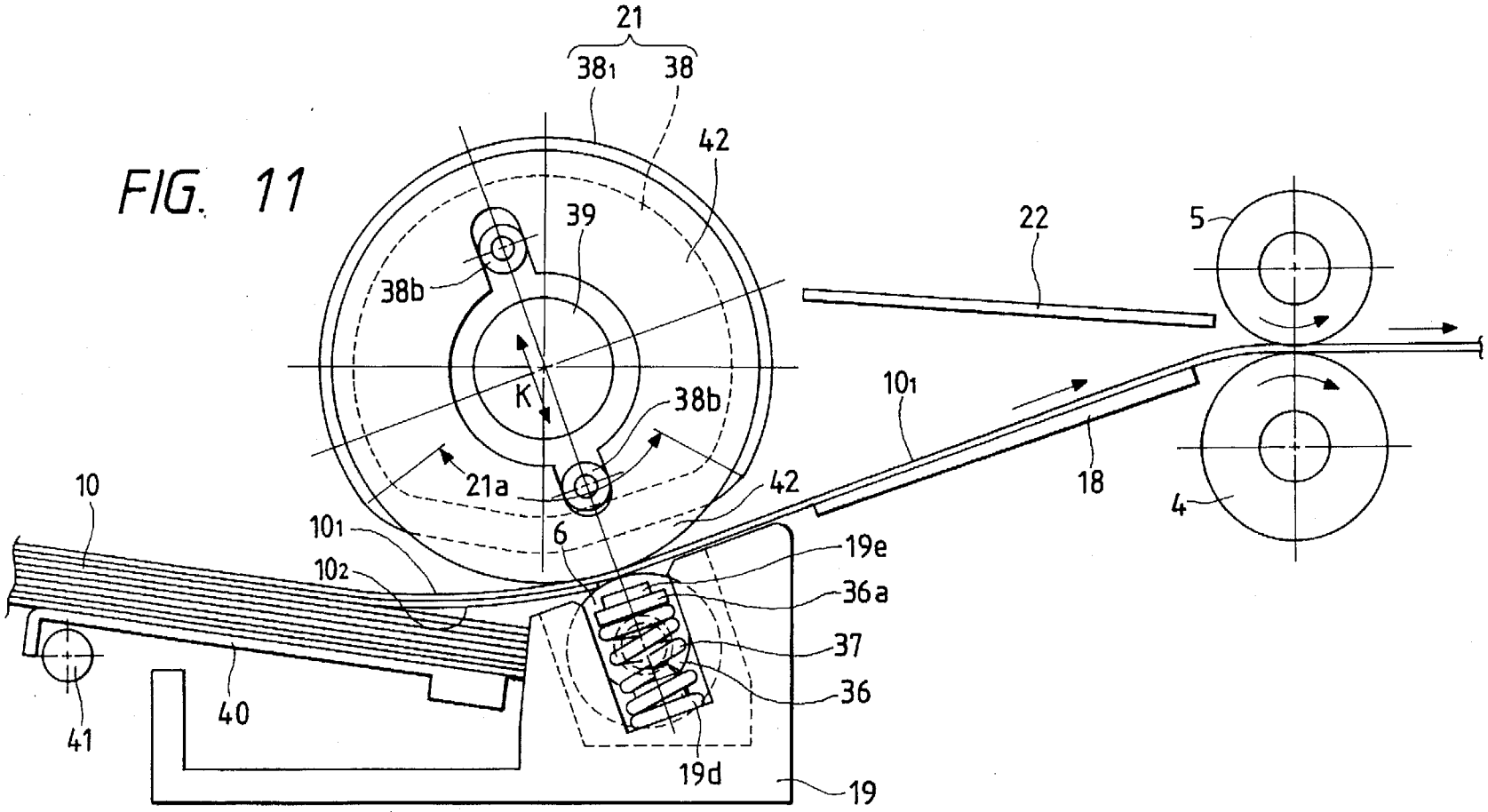
FIG. 11 is a side view of the sheet supplying mechanism of FIG. 10, showing a condition that the sheet supply roller is stopped and the recording material is being further conveyed by the pair of convey rollers.
Figure 12:
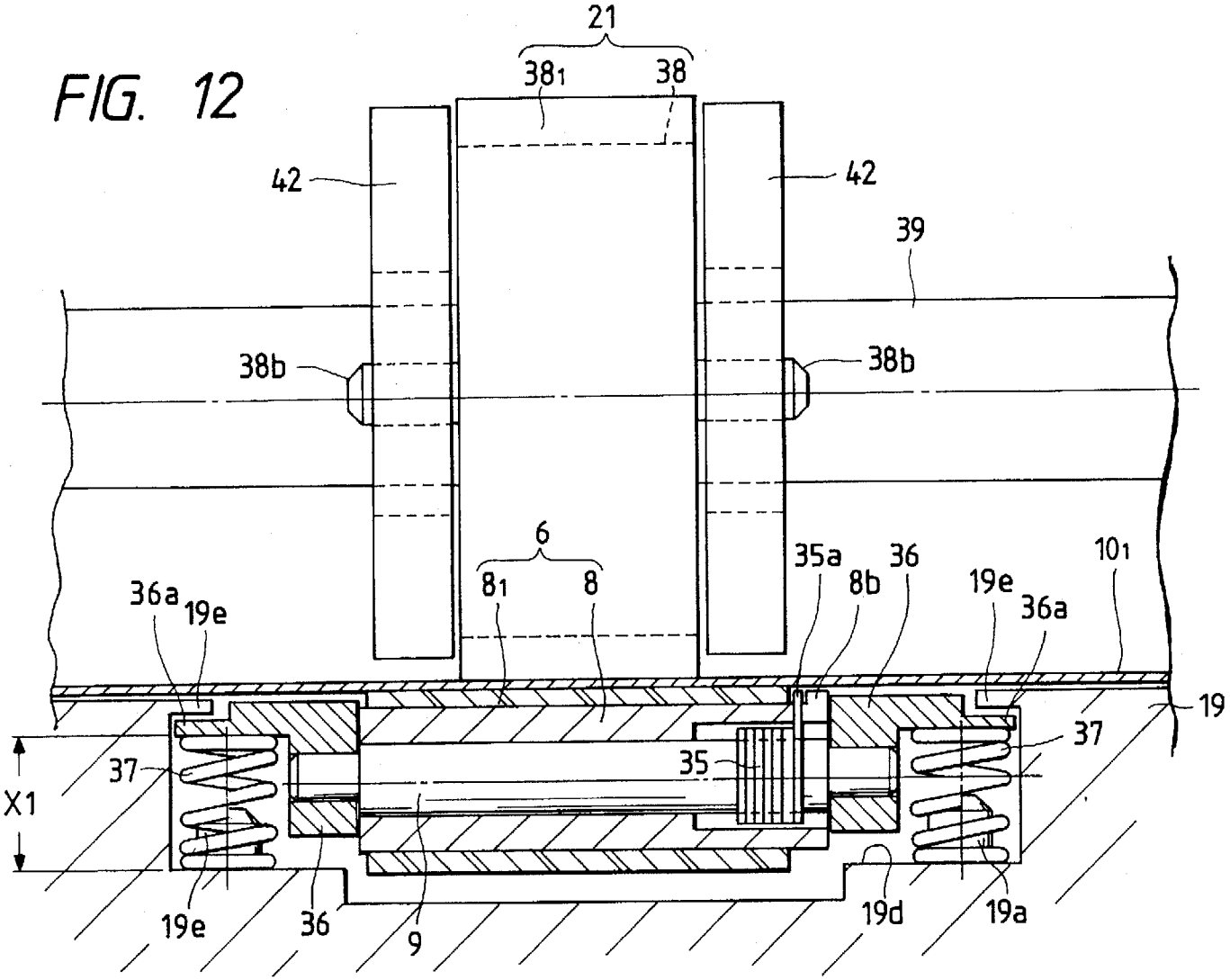
FIG. 12 is a front view of the sheet supply roller and a separation roller in the condition shown in FIG. 10 (the separation roller is shown as a sectional view)
Figure 13:
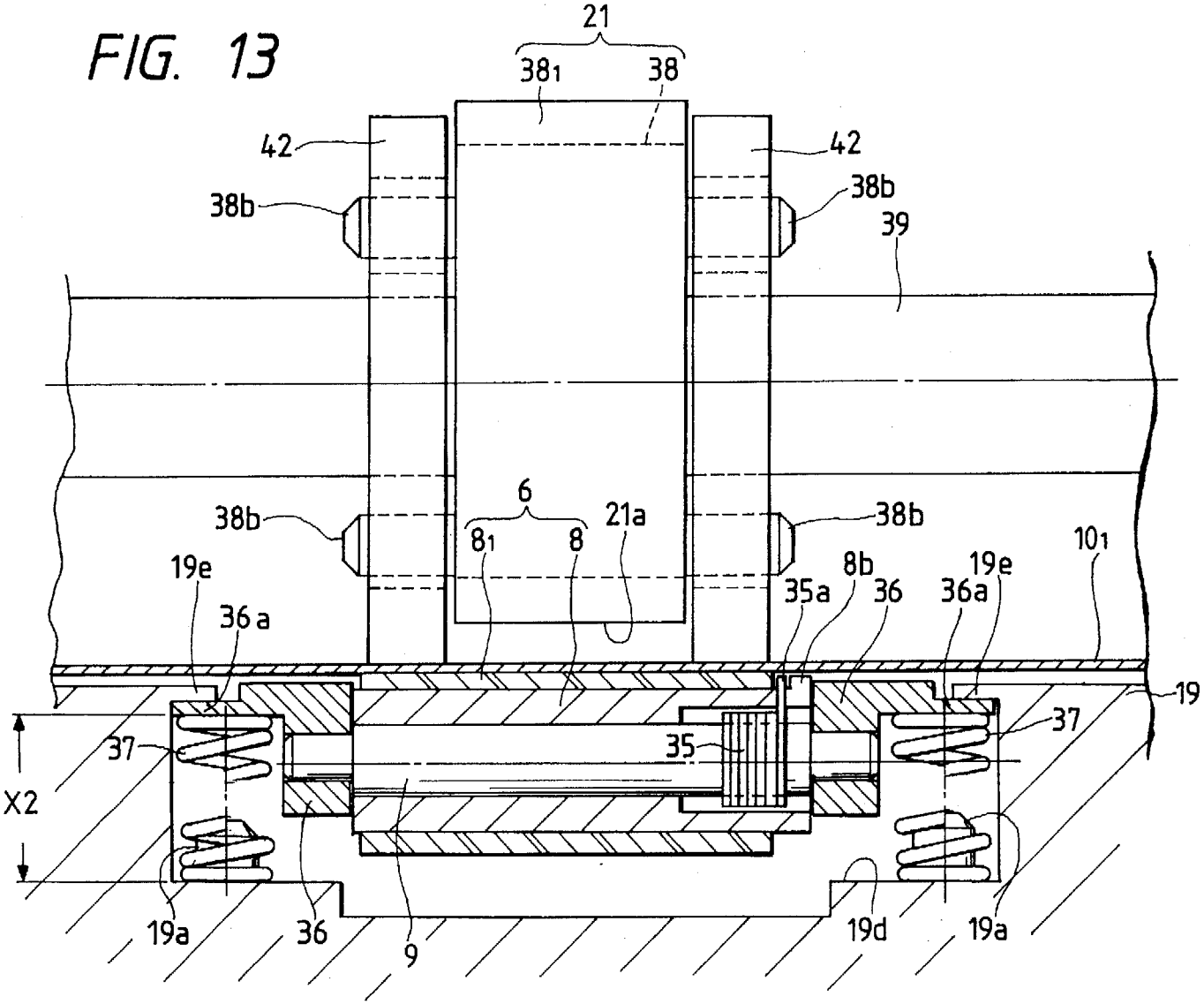
FIG. 13 is a front view of the sheet supply roller and the separation roller in the condition shown in FIG. 11 (the separation roller is shown as a sectional view)

FIG. 10 is a side view of the sheet supplying apparatus showing a condition that a loop is formed in a recording material $\mathbf{10}_1$ supplied by the sheet supply roller 21 and abutted against the nip between the pair of regist rollers 4, 5, FIG. 11 is a side view of the sheet supplying apparatus showing a condition that the sheet supply roller 21 is stopped after one revolution and the recording material $\mathbf{10}_1$ is being further conveyed by the pair of convey rollers which are now driven, FIG. 12 is a front view of the sheet supply roller and the separation roller in the condition shown in FIG. 10 (the separation roller is shown as a sectional view), and FIG. 13 is a front view of the sheet supply roller and the separation roller in the condition shown in FIG. 11 (the separation roller is shown as a sectional view).

Guide members 42 are attached to side surfaces of the sheet supply roller 21 via positioning pins 38*b* of the sheet supply roller for shifting movement in directions shown by the arrow K. Further, stopper portions 19*e* for regulating the position of the separation roller 6 are provided on the sheet supply base 19.

During the sheet supplying operation effected by the sheet supply roller 21, as shown in FIGS. 10 and 12, the recording material $\mathbf{10}_1$ is conveyed while being pinched between the sheet supply roller 21 and the separation roller 6. In this case, the urging force between the sheet supply roller 21 and the separation roller 6 is created by the separation roller pressurizing springs 37 provided at the side of the separation roller 6. That is to say, during the sheet supplying operation, the apparatus of the second embodiment is operated in the same manner as that of the first embodiment.

After the sheet supply roller 21 is rotated by one revolution and is stopped (completion of the sheet supplying operation), the spring seat portions 36*a* of the separation roller bearings 36 are abutted against the stopper portions 19*e* of the sheet supply base 19, thereby regulating the forces of the separation roller springs 37 and the position of the separation roller 6. Further, in this case, the guide members 42 on the sheet supply roller 21 are shifted toward the separation roller 6 while being guided by the positioning pins 38*b*, thereby urging the separation roller 5 by their own weights.

With this arrangement, since the urging force between the sheet supply roller 21 and the separation roller 6 during the sheet supplying operation can be set to be different from the urging force (between the sheet supply roller 21 and the separation roller 6) after completion of the sheet supplying operation so that the optimum urging force for separating the recording material $\mathbf{10}_1$ is applied from the separation roller 6 during the sheet supplying operation and the smaller urging force can be obtained to reduce the sliding resistance acting on the recording material $\mathbf{10}_1$ at the sheet supplying zone after the completion of the sheet supplying operation, the technical advantage similar to that of the first embodiment can be achieved.

In the second embodiment, while an example that the urging force after the completion of the sheet supplying operation is generated by the weights of the guide members 42 themselves was explained, additional weak springs for biasing the guide members 42 toward the separation roller 6 may be provided to ensure the same advantage. Incidentally, since the other arrangements and operations are the same as those of the first embodiment, explanation thereof will be omitted.

<Third Embodiment>(FIGS. 14 to 17)

In this embodiment, driven guide members are provided on both sides of the sheet supply roller.

Figure 14:
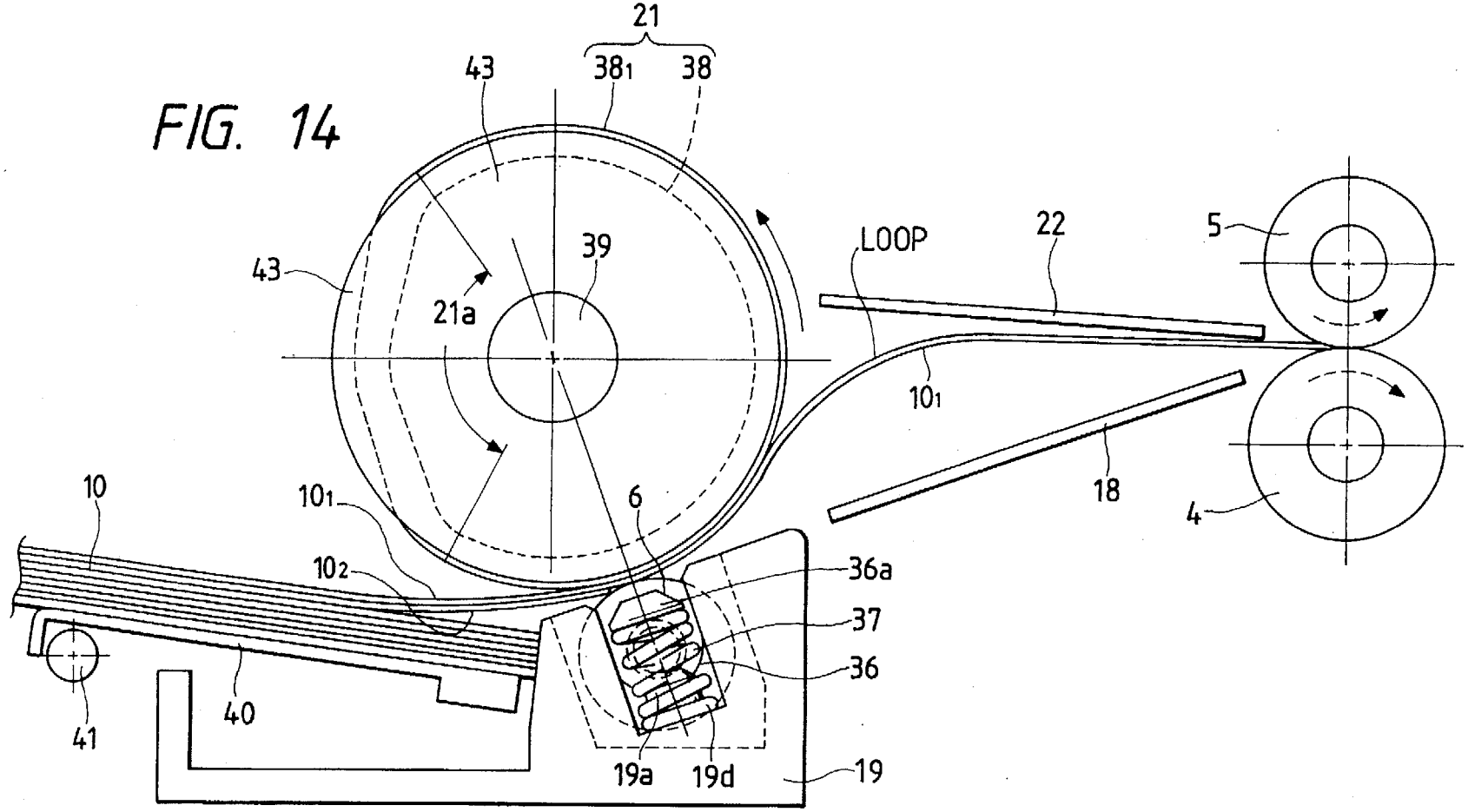
FIG. 14 is a side view of a sheet supplying mechanism of a sheet supplying apparatus according to a third embodiment of the present invention, showing a condition that a loop is formed in a recording material supplied by a sheet supply roller and abutted against a nip between a pair of convey rollers.
Figure 15:
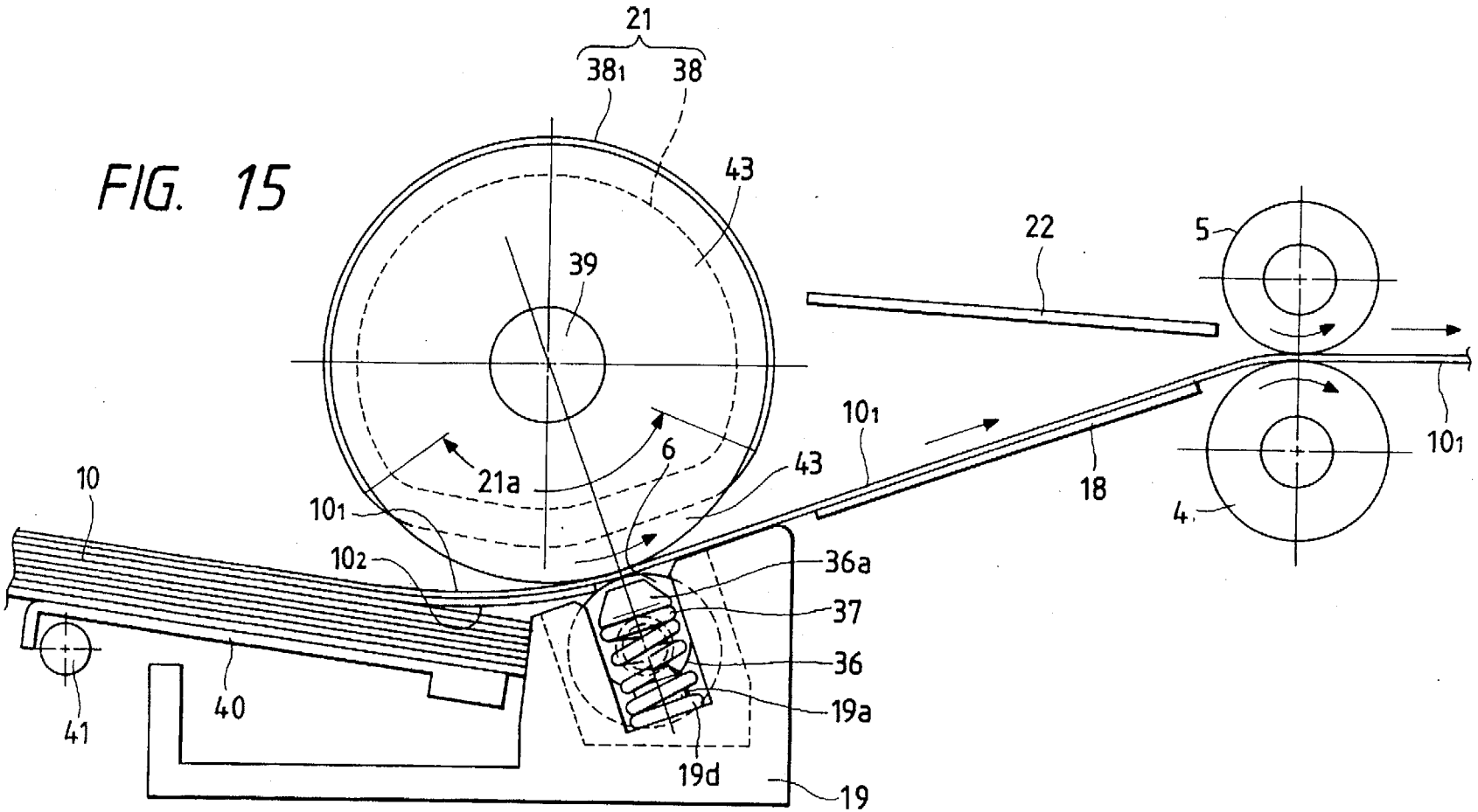
FIG. 15 is a side view of the sheet supplying mechanism of FIG. 14, showing a condition that the sheet supply roller is stopped and the recording material is being further conveyed by the pair of convey rollers.
Figure 16:
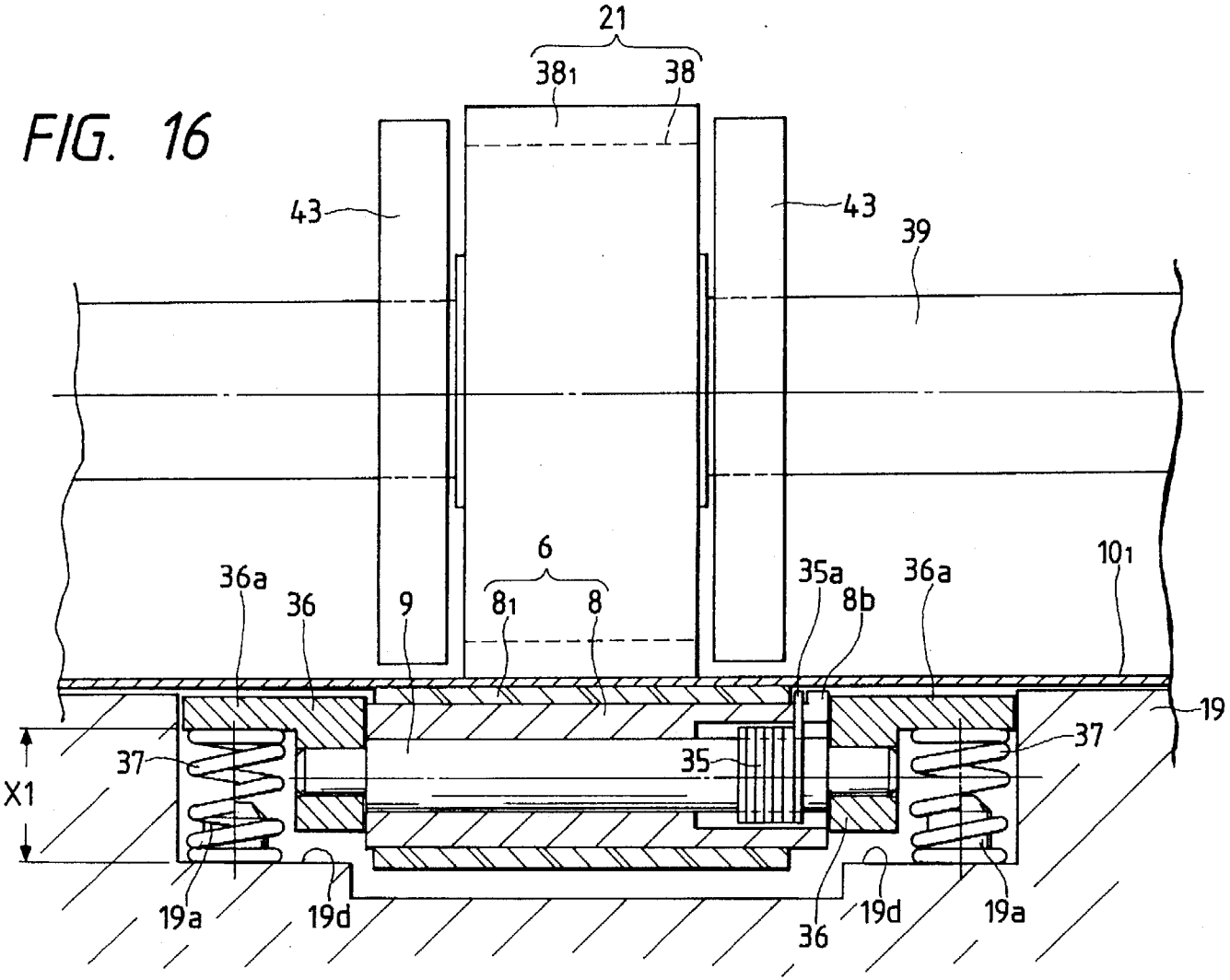
FIG. 16 is a front view of the sheet supply roller and a separation roller in the condition shown in FIG. 14 (the separation roller is shown as a sectional view)
Figure 17:
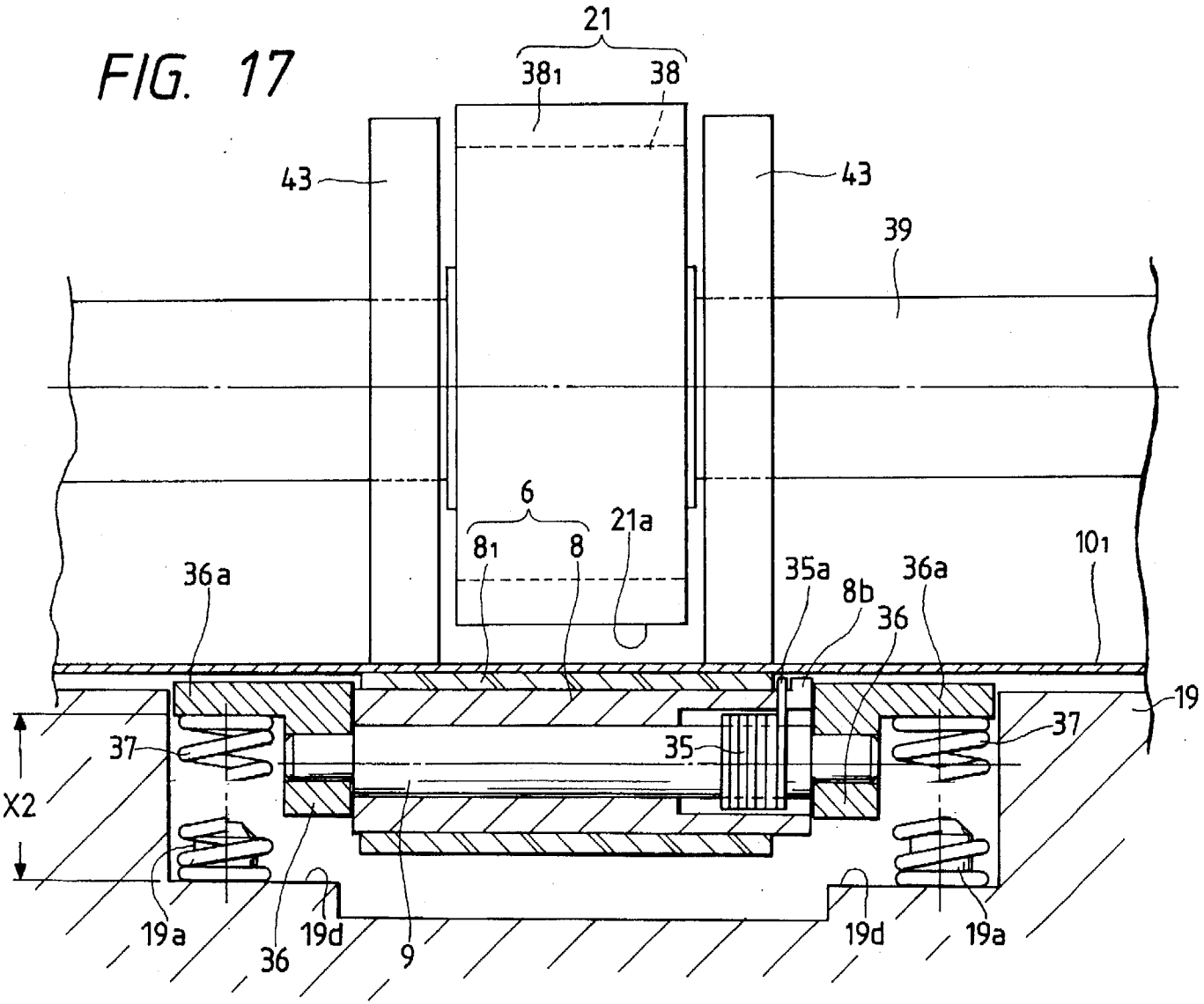
FIG. 17 is a front view of the sheet supply roller and the separation roller in the condition shown in FIG. 15 (the separation roller is shown as a sectional view)
Figure 18:
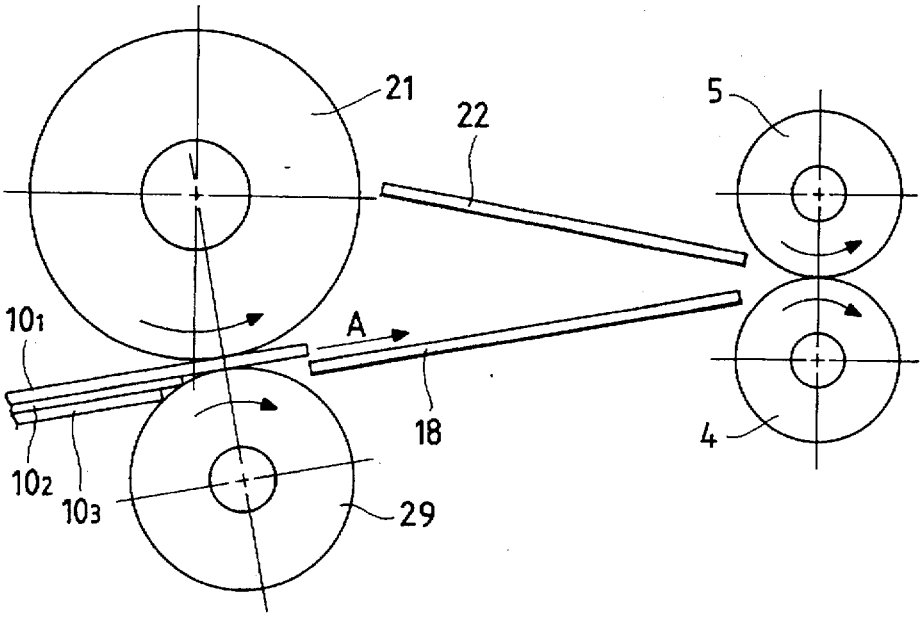
FIG. 18 PRIOR ART
FIGS. 18 and 19 are views for explaining an operation for separating a single recording material in a conventional sheet supplying apparatus.
Figure 19:
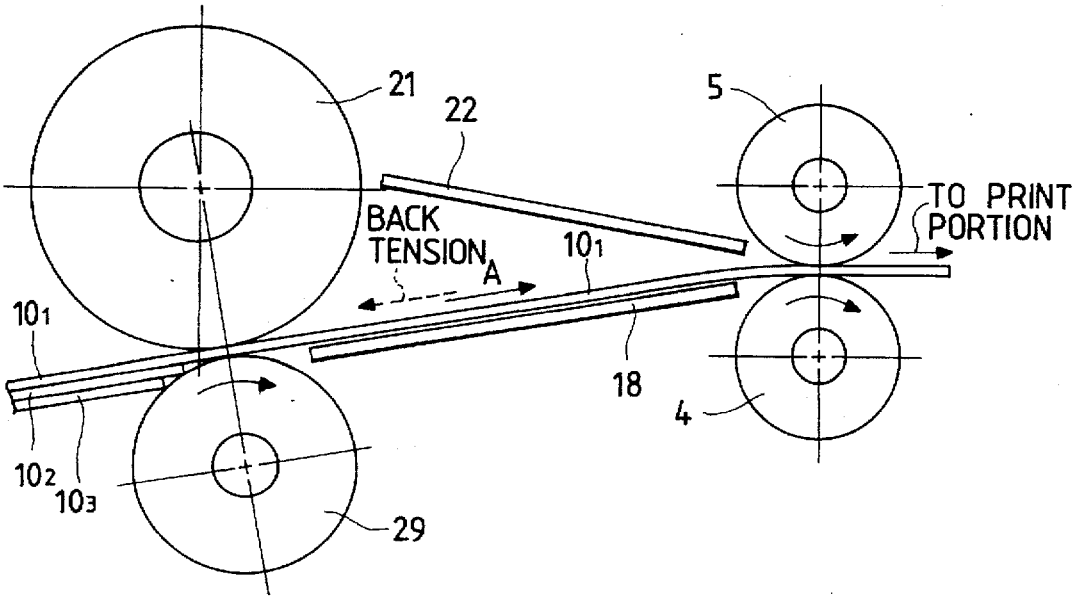
FIG. 19 PRIOR ART

FIG. 14 is a side view of a sheet supplying mechanism of a sheet supplying apparatus according to the third embodiment of the present invention, showing a condition that a loop is formed in a recording material $\mathbf{10}_1$ supplied by the sheet supply roller 21 and abutted against the nip between the pair of convey rollers 4, 5, FIG. 15 is a side view of the sheet supplying mechanism of FIG. 14, showing a condition that the sheet supply roller 21 is stopped after one revolution and the recording material $\mathbf{10}_1$ is being further conveyed by the pair of convey rollers 4, 5 which are now rotated, FIG. 16 is a front view of the sheet supply roller and the separation roller in the condition shown in FIG. 14 (the separation roller is shown as a sectional view), and FIG. 17 is a front view of the sheet supply roller and the separation roller in the condition shown in FIG. 15 (the separation roller is shown as a sectional view).

The sheet supply roller 21 is secured to the sheet supply roller shaft 39 by positioning pins (not shown). Driven guide members 43 are attached to the sheet supply roller shaft 39 on both sides of the sheet supply roller 21. The guide members 43 are comprised of disc plates each having a radius smaller than that of the cylindrical portion of the sheet supply roller 21 and greater than that of the cut-out portion of the sheet supply roller 21. Since the construction of the separation roller is the same as that of the first embodiment, explanation thereof will be omitted.

During the sheet supplying operation, as shown in FIGS. 14 and 16, the recording material $10_1$ is conveyed while being pinched between the sheet supply roller 21 and the separation roller 6. That is to say, the sheet supplying operation is the same as that of the first embodiment.

Next, an operation after the completion of the sheet supplying operation will be explained with reference to FIGS. 15 and 17. In this condition, the guide members 43 are abutted against the separation roller 6 with the interposition of the recording material $10_1$. In this case, since the guide members 43 can be rotatingly driven, the recording material $10_1$ is conveyed while rotating the guide members 43 by the shifting movement of the recording material. Thus, since the sliding resistance acting on the recording material $10_1$ at the sheet supplying zone can be reduced, the technical advantage similar to that of the first embodiment can be achieved. Incidentally, since the other arrangements and operations are the same as those of the first embodiment, explanation thereof will be omitted.

<Fourth Embodiment>(FIGS. 20 to 24)

FIGS. 20 to 24 show a sheet supplying apparatus according to a fourth embodiment of the present invention. The same constructional elements as those of the first embodiment fare designated by the same reference numerals and detailed explanation thereof will be omitted.

In this fourth embodiment, driven guide members which can be abutted against the separation roller by their own weight or by biasing members are arranged on both sides of the sheet supply roller, so that the sheet supply roller is abutted against the separation roller during the sheet supplying operation and the separation roller is separated from the sheet supply roller after the completion of the sheet supplying operation.

More particularly, the guide members 44 made of resin having a low coefficient of friction are rotatably mounted on a rotary shaft $38_2$ integrally formed with the metal core 38 of the sheet supply roller 21, and each guide member 44 has a central hole $44_1$ having a diameter greater than a diameter of the rotary shaft $38_2$. With this arrangement, the guide members 44 can be abutted against the separation roller 6 by their own weight and be rotatingly driven. Incidentally, the construction and operation of the sheet supply roller 21 and the separation roller 6 are the same as those of the first embodiment.

Next, the sheet supplying operation will be explained.

Figure 20:
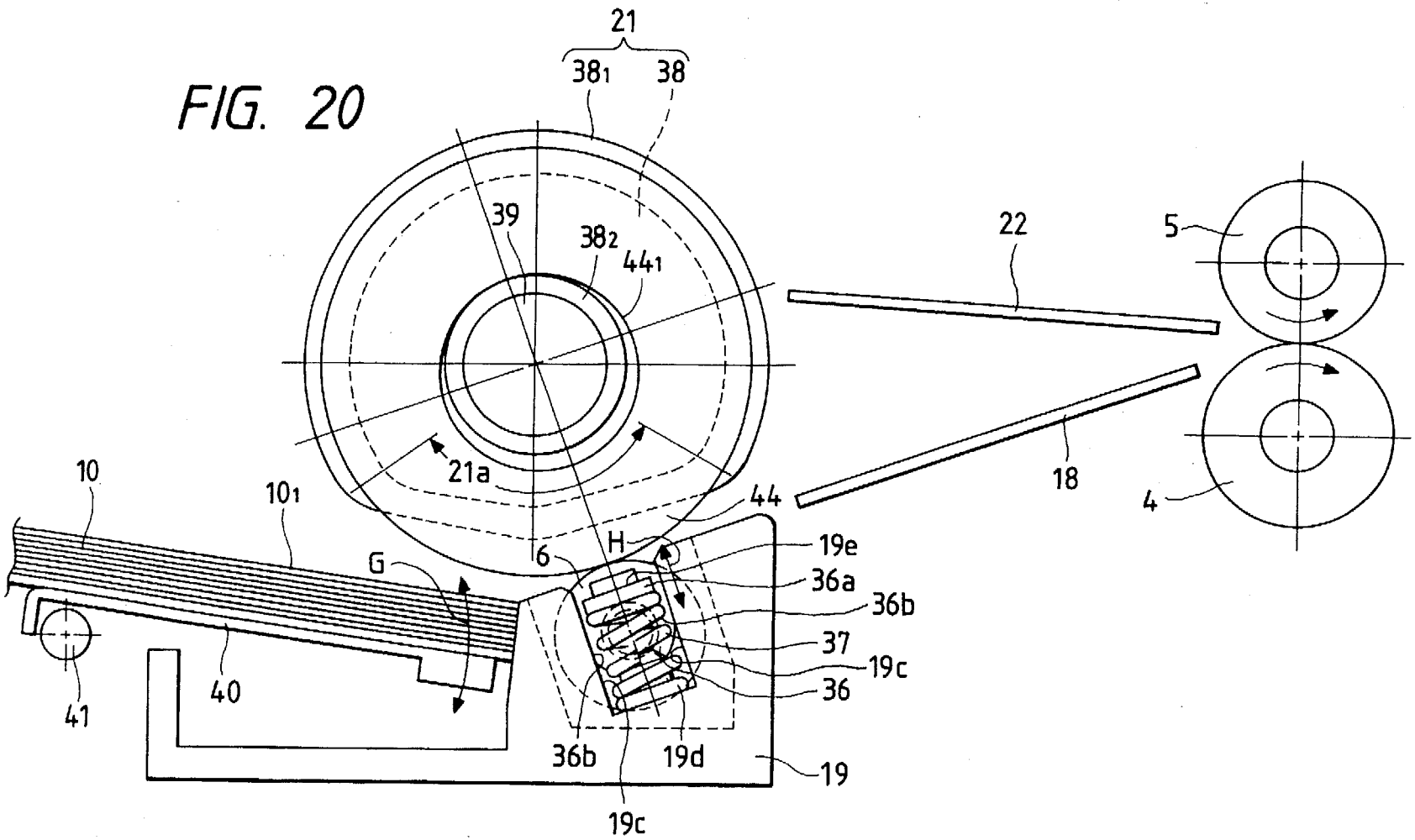
FIG. 20 is a side view of a sheet supplying mechanism showing a waiting condition.

(i) In the waiting condition shown in FIG. 20, the sheet supply roller 21 and the guide portions 38 are stopped so that the cut-out portion 21*a* is directed downwardly. The separation roller 6 is abutted against the guide members 44.

(ii) From the waiting condition shown in FIG. 20, when the sheet supply start signal is emitted, the solenoid of the one-revolution clutch is energized to turn the clutch ON, with the result that the driving force of the drive source (not shown) is transmitted to the sheet supply roller shaft 39, thereby rotating the sheet supply roller 21 in the sheet supplying direction. At the same time, the sheet supply intermediate plate 40 of the sheet supply tray 20 is rocked upwardly by the cam mechanism (not shown). As a result, the upper surface of the tip end portion of the sheet stack 10 is urged against the cylindrical portion of the sheet supply roller 21 other than the cut-out portion 21*a* with predetermined abutting pressure, thereby applying the conveying force to the uppermost recording material $10_1$ to convey the uppermost recording material $10_1$ to the nip between the sheet supply roller 21 and the separation roller 6.

When the sheet supply roller 21 is further rotated, the uppermost recording material $10_1$ is conveyed by the sheet supply roller 21. In this case, by the separating operation (FIGS. 8 and 9) of the separation roller 6 as mentioned above, the recording materials are positively separated one by one at the nip without the double-feed. Further, after the tip end 10 of the uppermost recording material $10_1$ enters into the nip between the sheet supply roller 21 and the separation roller 6, the sheet supply intermediate plate 40 of the sheet supply tray 20 is lowered by the cam mechanism (not shown).

Figure 21:
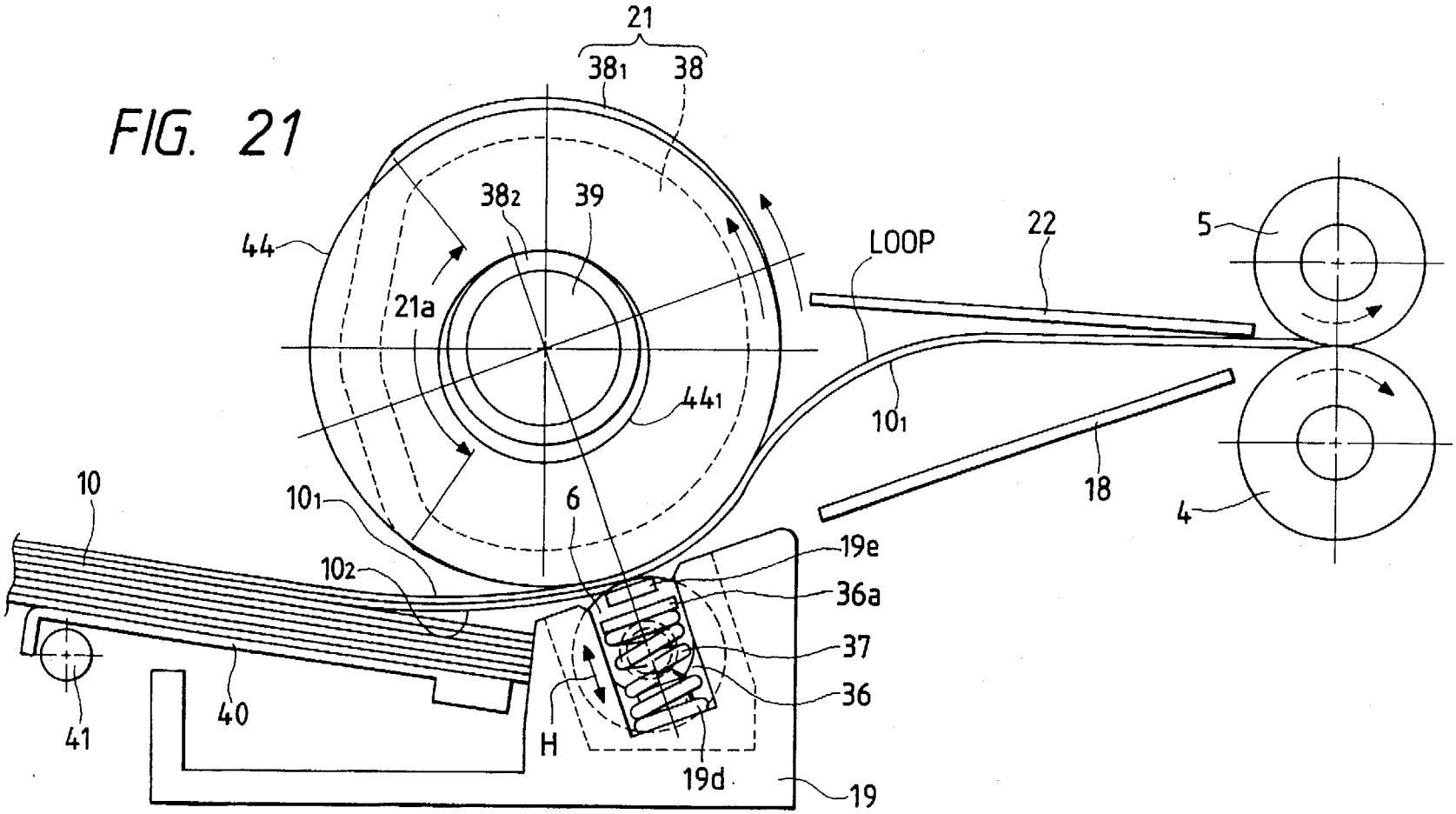
FIG. 21 is a side view of the sheet supplying mechanism showing a condition that a loop is formed in a recording material supplied from a sheet supply tray by a sheet supply roller and abutted against a nip between a pair of convey rollers.
Figure 23:
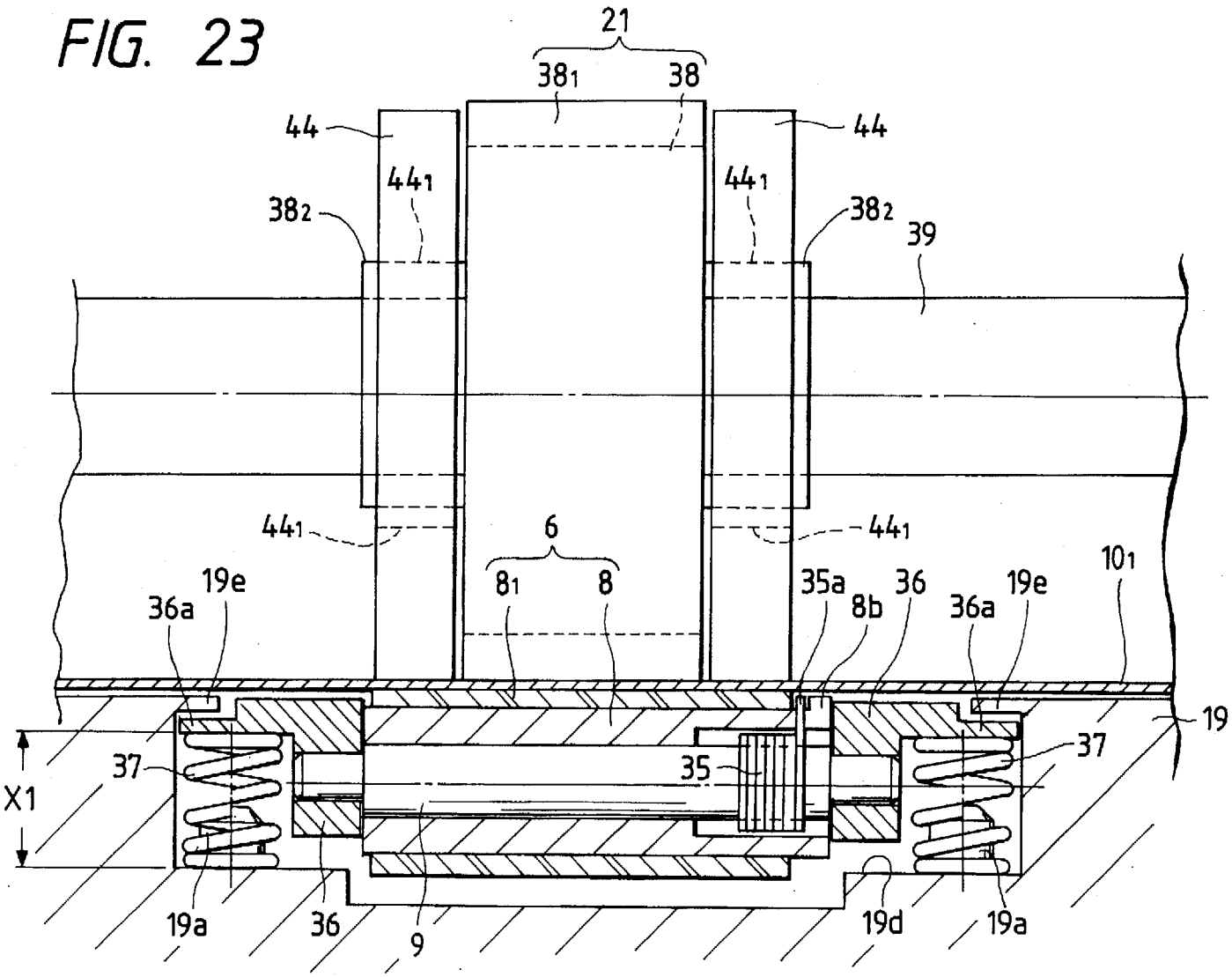
FIG. 23 is a front view of the sheet supply roller and a separation roller in the condition shown in FIG. 21 (the separation roller is shown as a sectional view)

When the sheet supply roller 21 is further rotated in the sheet supplying direction, as shown in FIG. 21, the tip end of the separated recording material $10_1$ reaches the nip between the pair of convey rollers (regist rollers) 4, 5 which are now stopped, and then, a loop is formed in the recording material $10_1$ between the nip of the convey rollers 4, 5 and the nip of the rollers 21, 6, thereby correcting the skew-feed of the recording material $10_1$. Incidentally, FIG. 23 is a front view of the sheet supply roller 21 and the separation roller 6 in the condition shown in FIG. 21 (the separation roller is shown as a sectional view).

During the rotation of the sheet supply roller 21, the separation roller 6 is being rotated together with the sheet supply roller 21 with the interposition of the recording material 10. In this case, the urging force between the sheet supply roller 21 and the separation roller 6 is generated by the separation roller pressurizing springs 37, and the guide members 44 are abutted against the separation roller 6 by their own weight and driven by the separation roller. After the tip end of the recording material $10_1$ is abutted against the pair of regist rollers 4, 5 and the loop is formed in the recording material $10_1$, the pair of regist rollers 4, 5 are rotated in synchronism with the sheet supply roller 21 at a predetermined point.

Figure 22:
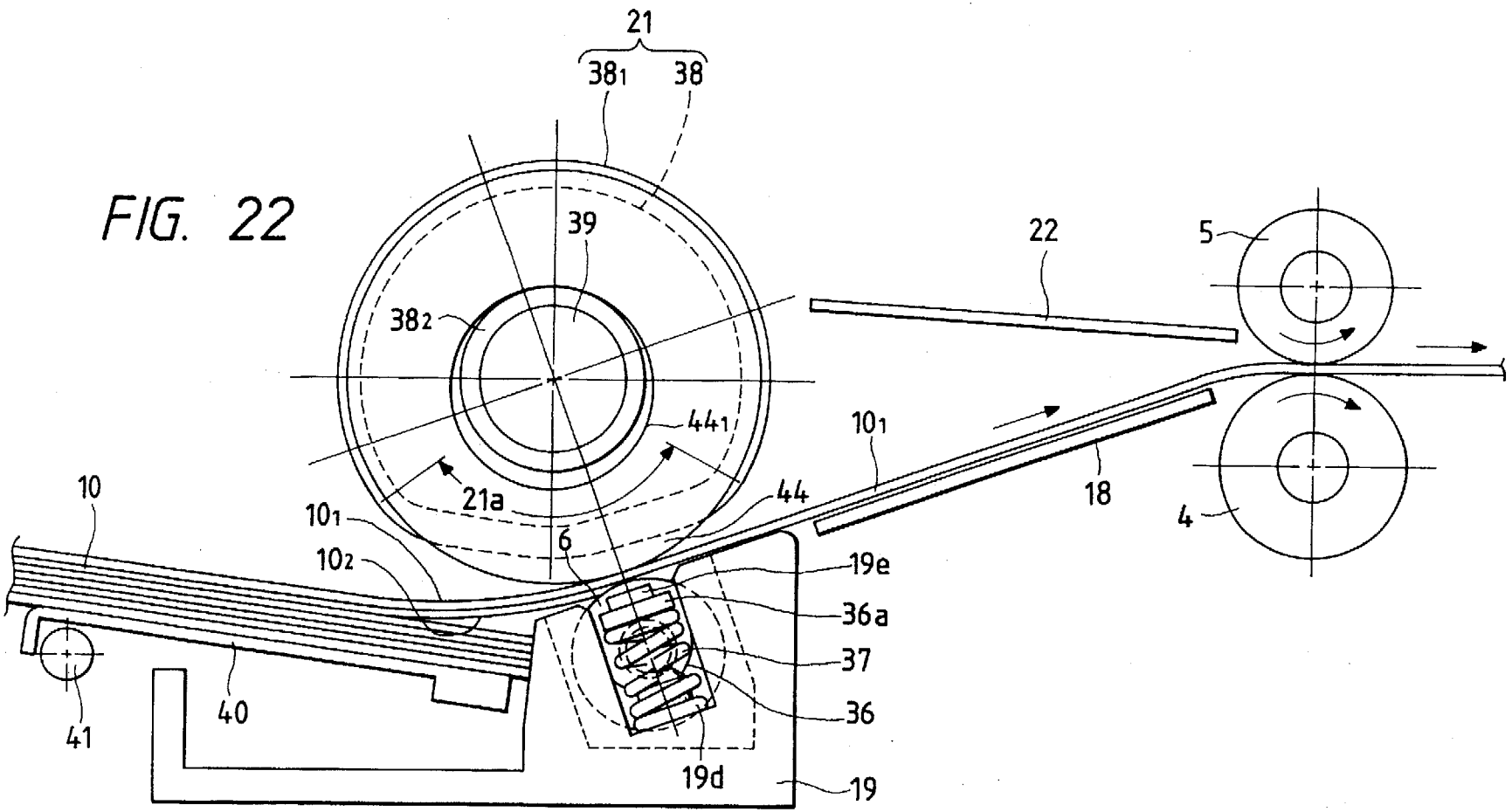
FIG. 22 is a side view of the sheet supplying mechanism showing a condition that the sheet supply roller is stopped and the recording material is being further conveyed by the pair of convey rollers.
Figure 24:
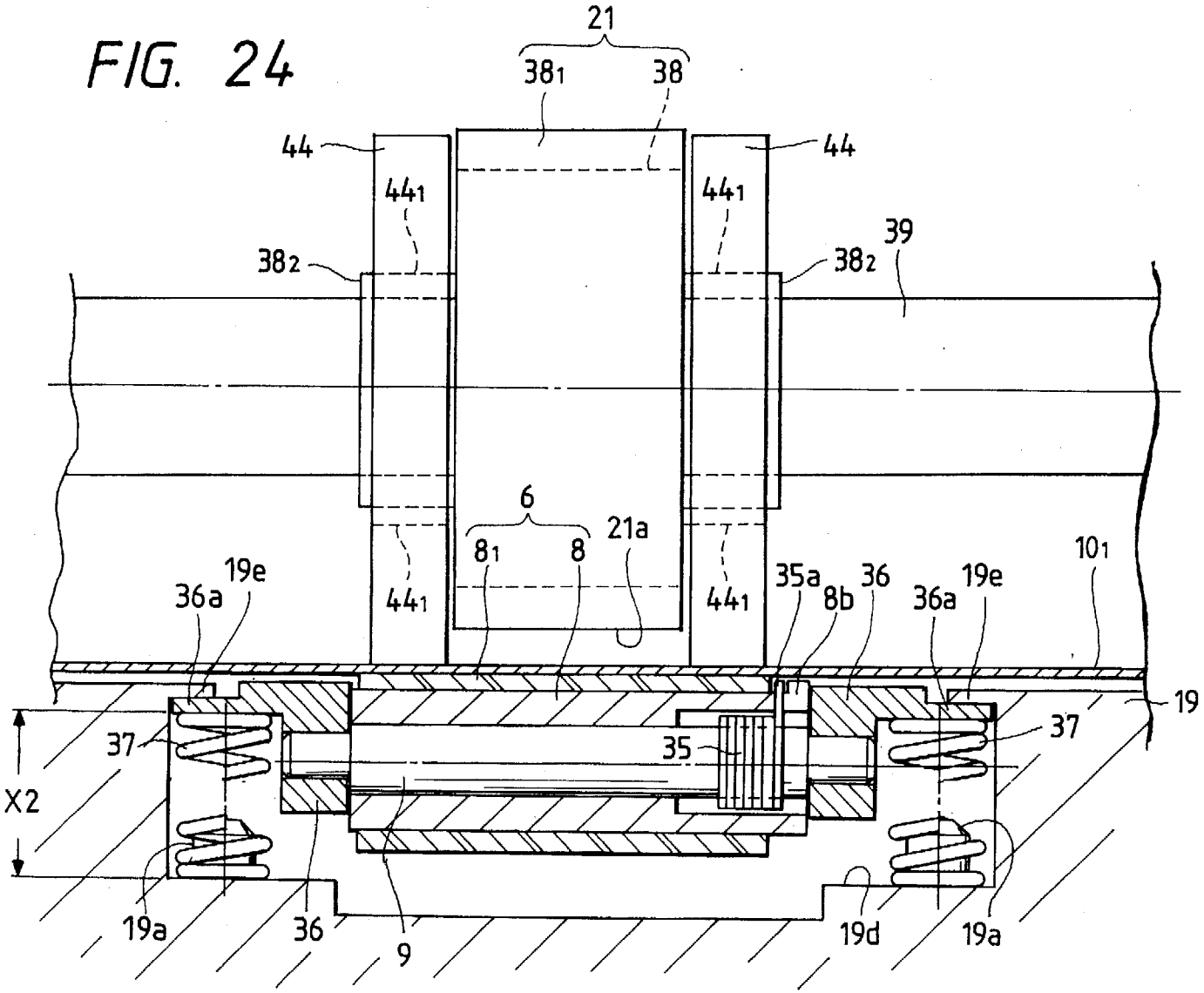
FIG. 24 is a front view of the sheet supply roller and the separation roller in the condition shown in FIG. 22 (the separation roller is shown as a sectional view).

(iii) When the sheet supply roller 21 is rotated by one revolution, the one-revolution clutch is turned OFF, thereby stopping the sheet supply roller. At this point, the sheet supplying operation effected by the sheet supply roller 21 is finished. The recording material $10_1$ is conveyed by the pair of regist rollers 4, 5 which are still rotated after the sheet supply roller 21 is rotated by one revolution. FIG. 22 shows such a condition. The recording material $10_1$ conveyed by the pair of regist rollers 4, 5 is conveyed to the recording station, where the image is recorded on the recording material. FIG. 24 is a front view of the sheet supply roller 21 and the separation roller 6 in the condition shown in FIG. 24 (the separation roller is shown as a sectional view).

With this arrangement, since the urging force of the separation roller is regulated and the guide members apply only the weak force to the recording material and are rotatingly driven, the sliding resistance acting on the recording material $10_1$ can be reduced, thereby preventing the deterioration of the imaged surface of the recording material $10_1$ due to the sliding movement. Further, since the sliding resistance is small, the back tension on the recording material generated by the conveying force of the pair of regist rollers 4, 5 can be decreased.

Further, with the arrangement as mentioned above, the urging force between the sheet supply roller 21 and the separation roller 6 during the sheet supplying operation can be set to be different from the urging force (between the sheet supply roller 21 and the separation roller 6) after completion of the sheet supplying operation so that the optimum urging force for separating the recording material $10_1$ is applied from the separation roller 6 during the sheet supplying operation and the smaller urging force can be obtained to reduce the sliding resistance acting on the recording material $10_1$ at the sheet supplying zone after the completion of the sheet supplying operation.

Incidentally, in the fourth embodiment, while an example that the urging force after the completion of the sheet supplying operation is generated by the weight of the guide members 44 themselves was explained, additional elastic members for biasing the guide members 44 toward the separation roller 6 may be provided to ensure the same advantage.

As mentioned above, according to the present invention, the separation roller having the torque limiter mechanism using the spring clutch for rotating the separation roller in the sheet returning direction is used in the separating mechanism during the sheet supplying operation, and, when the sheet supplying operation is finished, the sheet supply roller having the cylindrical portion and the cut-out portion (having the smaller radius than that of the cylindrical portion) is stopped so that the cut-out portion is opposed to the separation roller. With this arrangement, the back tension acting on the recording material can be reduced and the slip of the recording material at the pair of convey rollers can be eliminated, thereby preventing poor sheet supply. Further, in the recording apparatus, the stable and high accurate feeding of the recording material can be achieved at the recording station. In addition, since the back tension acting on the recording material is small, the pressurizing mechanism associated with the convey rollers can be simplified. Furthermore, since the driving torque for the convey rollers can be reduced, the drive motor can be made small, thereby making the entire apparatus inexpensive.

What is claimed is:

1. A recording apparatus comprising:

a sheet supply roller provided at its periphery with a cylindrical portion for supplying a sheet and a cut-out portion having a radial distance smaller than a radius of said cylindrical portion, said sheet supply roller being rotatable to supply a sheet;

friction separation means movable toward and away from said sheet supply roller to separate sheets one by one by cooperating with said cylindrical portion of said sheet supply roller;

biasing means for biasing said friction separation means toward said sheet supply roller;

rotation control means for stopping said sheet supply roller so that the cut-out portion is opposed to said friction separation means after the sheet is supplied by said cylindrical portion;

pinch means for pinching the sheet fed out by said sheet supply roller together with said friction separation means when said sheet supply roller is stopped by said rotation control means;

supporting means for supporting said pinch means to be shifted in a same direction as movement of said friction separation means when said pinch means guides the sheet, said supporting means having a positioning pin provided on one of a side surface of said sheet supply roller and said pinch means and a slit provided on the other of them to slidingly receive said positioning pin; and recording means for effecting recording on the sheet fed out by said sheet supply roller.

2. A sheet supplying apparatus comprising:

a sheet supply roller provided at its periphery with a cylindrical portion for supplying a sheet and a cut-out portion having a radial distance smaller than a radius of said cylindrical portion, said sheet supply roller being rotatable to supply a sheet;

friction separation means movable toward and away from said sheet supply roller for separating sheets one by one by cooperating with said cylindrical portion of said sheet supply roller;

biasing means for biasing said friction separation means toward said sheet supply roller;

rotation control means for stopping said sheet supply roller so that the cut-out portion is opposed to said friction separation means after the sheet is supplied by said cylindrical portion;

pinch means for pinching the sheet fed out by said sheet supply roller together with said friction separation means when said sheet supply roller is stopped by said rotation control means; and supporting means for supporting said pinch means to be shifted in a same direction as movement of said friction separation means when said pinch means guides the sheet, said supporting means having a positioning pin provided on one of a side surface of said sheet supply roller and said pinch means and a slit provided on the other of them to slidingly receive said positioning pin.

3. A sheet supplying apparatus according to claim 2, wherein said pinch means has a radial distance greater than the radial distance of the cut-out portion and smaller than the radius of said cylindrical portion.

4. A sheet supplying apparatus according to claim 2, wherein said pinch means comprises a disc plate.

5. A sheet supplying apparatus according to claim 2, wherein said pinch means comprises a disc shaped roller rotatably supported on a shaft of said sheet supply roller, and said supporting means includes a hole formed in said disc shaped roller and having a diameter greater than a diameter of said shaft of said sheet supply roller and into which said shaft is inserted.

6. A sheet supplying apparatus according to claim 5, wherein a radius of said pinch means is smaller than the radius of said cylindrical portion.

7. A sheet supplying apparatus according to claim 2, further comprising convey means arranged downstream of said sheet supply roller to convey the sheet fed out by said sheet supply roller, and after said convey means starts to convey the sheet, convey cut-out portion is opposed to said friction separation means.

8. A sheet supplying apparatus according to claim 2, further comprising a liftable/lowerable plate for abutting a sheet stack against said sheet supply roller to feed out a sheet, with said plate being lowered to release the sheet stack from said sheet supply roller after the sheet is fed out.

9. A sheet supplying apparatus according to claim 2, wherein said friction separation means includes a rotatable separation roller and a torsion coil spring for applying torque to said separation roller to rotate said separation roller in a sheet returning direction, and when a trailing end of the sheet fed out by said sheet supply roller passes through said separation roller, said separation roller is rotated by the torque to return a next sheet.

10. A recording apparatus comprising:

a sheet supply roller provided at its periphery with a cylindrical portion for supplying a sheet and a cut-out portion having a radial distance smaller than a radius of said cylindrical portion, said sheet supply roller being rotatable to supply a sheet;

friction separation means movable toward and away from said sheet supply roller for separating sheets one by one by cooperating with said cylindrical portion of said sheet supply roller;

biasing means for biasing said friction separation means toward said sheet supply roller;

rotation control means for stopping said sheet supply roller so that the cut-out portion is opposed to said friction separation means after the sheet is supplied by said cylindrical portion;

regulating means for regulating movement of said friction separating means toward said sheet supply roller beyond a predetermined position in opposition to a biasing force of said biasing means, wherein said predetermined position is a position in which said friction separation means is away from said cut-out portion when said cut-out portion of said sheet supply roller is opposed to said friction separation means;

pinch means shiftable in a same direction as movement of said friction separation means for pinching the sheet fed out by said sheet supply roller together with said friction separation means regulated by said regulating means when said sheet supply roller is stopped by said control means; and recording means for effecting recording on the sheet fed out by said sheet supply roller.

11. A sheet supplying apparatus comprising:

a sheet supply roller provided at its periphery with a cylindrical portion for supplying a sheet and a cut-out portion having a radial distance smaller than a radius of said cylindrical portion, said sheet supply roller being rotatable to supply a sheet;

friction separation means movable in a direction toward and away from said sheet supply roller for separating sheets one by one by cooperating with said cylindrical portion of said sheet supply roller;

biasing means for biasing said friction separation means toward said sheet supply roller;

rotation control means for stopping said sheet supply roller so that said cut-out portion is opposed to said friction separation means after the sheet is supplied by said cylindrical portion;

regulating means for regulating movement of said friction separating means toward said sheet supply roller beyond a predetermined position in opposition to a biasing force of said biasing means, wherein said predetermined position is a position in which said friction separation means is away from said cut-out portion when said cut-out portion of said sheet supply roller is opposed to said friction separation means; and pinch means shiftable in the movement direction of said friction separation means for pinching the sheet fed out by said sheet supply roller together with said friction separation means regulated by said regulating means when said sheet supply roller is stopped by said control means.

12. A sheet supply apparatus according to claim 11, wherein said pinch means is a disc-shaped roller supported on a shaft of said sheet supply roller and having a hole to receive the shaft loosely.

13. A sheet supplying apparatus according to claim 11, wherein said guide means is abutted, by its own weight, against said friction separation means stopped by said stopper means.

14. A sheet supplying apparatus according to claim 13, wherein said pinch means comprises a disc-shaped roller rotatably supported on a shaft of said sheet supply roller, said disc-shaped roller having a hole which has a diameter greater than a diameter of said shaft of said sheet supply roller and into which said shaft is inserted.

15. A sheet supplying apparatus according to claim 11, further comprising convey means arranged downstream of said sheet supply roller to convey the sheet fed out by said sheet supply roller, and after said convey means starts to convey the sheet, the cut-out portion is opposed to said friction separation means.

16. A sheet supplying apparatus according to claim 11, further comprising a liftable/lowerable plate for abutting a sheet stack against said sheet supply roller to feed out a sheet, with said plate being lowered to release the sheet stack from said sheet supply roller after the sheet is fed out.

17. A sheet supplying apparatus according to claim 11, wherein said friction separation means includes a rotatable separation roller and a torsion coil spring for applying torque to said separation roller to rotate said separation roller in a sheet returning direction, and when a trailing end of the sheet fed out by said sheet supply roller passes through said separation roller, said separation roller is rotated by the torque to return a next sheet.

* * * * *

UNITED STATES PATENT AND TRADEMARK OFFICE

CERTIFICATE OF CORRECTION

PATENT NO. : 5,738,452
DATED : April 14, 1998
INVENTOR(S) : Haruo UCHIDA

It is certified that error appears in the above-identified patent and that said Letters Patent is hereby corrected as shown below:

Title Page, [56] References Cited, U.S. Patent Documents, delete "3/1982" and insert therefor --6/1994--.

Column 2, line 1, delete "resistence" and insert therefor --resistance--;
Lines 19 and 23, delete "synchronous", both occurrences, and insert therefor --synchronism--;
Line 36, delete "arising" and insert therefor --giving rise to--;
Line 57, delete "biaing" and insert therefor --biasing--.

Column 3, line 6, after "than", insert --the--.

Column 5, line 43, delete "10".

Column 6, line 63, after "and", insert --9)--;
Line 64, delete "9)".

Column 7, line 21, delete "loosing" and insert therefor --loosening--.

Column 11, line 25, delete "fare" and insert therefor --are--.

Column 12, line 7, delete "10".

Column 16, line 11, delete "supply" and insert therefor --supplying--;
Line 17, delete "guide" and insert therefor --pinch--.

Signed and Sealed this

First Day of December, 1998

*Attest:*

Bruce Lehman

BRUCE LEHMAN

*Attesting Officer*

*Commissioner of Patents and Trademarks*